US008540068B2

(12) United States Patent
Nakamoto et al.

(10) Patent No.: US 8,540,068 B2
(45) Date of Patent: Sep. 24, 2013

(54) MONEY HANDLING MACHINE

(75) Inventors: Tasuku Nakamoto, Ako (JP); Kazuhiro Doi, Himeji (JP); Yasuhiro Matsumoto, Himeji (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/259,391

(22) PCT Filed: Mar. 12, 2010

(86) PCT No.: PCT/JP2010/054204

§ 371 (c)(1),
(2), (4) Date: Sep. 23, 2011

(87) PCT Pub. No.: WO2010/110089

PCT Pub. Date: Sep. 30, 2010

(65) Prior Publication Data

US 2012/0012436 A1 Jan. 19, 2012

(30) Foreign Application Priority Data

Mar. 23, 2009 (JP) ..... 2009-069658
Mar. 23, 2009 (JP) ..... 2009-070601

(51) Int. Cl.
*G06M 3/00* (2006.01)

(52) U.S. Cl.
USPC ..... 194/215

(58) Field of Classification Search
USPC ..... 194/215, 217; 209/534; 235/379; 902/12; 700/215; 705/17
See application file for complete search history.

(56) References Cited

U.S. PATENT DOCUMENTS

| | | | | |
|---|---|---|---|---|
| 5,056,643 | A * | 10/1991 | Kirberg | 194/202 |
| 6,109,416 | A * | 8/2000 | Nickerson | 194/206 |
| 2004/0124063 | A1* | 7/2004 | Tezuka | 194/241 |
| 2005/0256792 | A1* | 11/2005 | Shimizu et al. | 705/35 |

FOREIGN PATENT DOCUMENTS

| | | | |
|---|---|---|---|
| EP | 1 376 488 | A1 | 1/2004 |
| EP | 1 413 996 | A2 | 4/2004 |
| JP | 09-161124 | | 6/1997 |
| JP | 11-120413 | | 4/1999 |
| JP | 2001-067526 | | 3/2001 |

(Continued)

OTHER PUBLICATIONS

European Search Report (Application No. 10755889.2 PCT/JP2010/054204) (8 pages—dated Oct. 23, 2012).

(Continued)

*Primary Examiner* — Mark Beauchaine
(74) *Attorney, Agent, or Firm* — Renner, Kenner, Greive, Bobak, Taylor & Weber

(57) ABSTRACT

In a control unit (50), a predetermined amount of money of fund money that is the money to be dispensed as the change or the like (i.e., predetermined denominations and the number for each denomination or predetermined total amount of the fund money) is set in advance. The control unit (50) controls an insertion unit (12), a transport unit (16), a storing unit (22) and an escrow unit (20), so as to automatically perform a dispensing process for feeding the money corresponding to the predetermined amount of the fund money from the storing unit (22) to a dispensing unit (14), after the control unit (50) serves to perform a depositing process for taking the money into a casing (10) from the exterior thereof via the insertion unit (12), and then feeding the money taken in the casing (10) to the escrow unit (20).

4 Claims, 11 Drawing Sheets

(56) References Cited

FOREIGN PATENT DOCUMENTS

| | | |
|---|---|---|
| JP | 2001-351152 | 12/2001 |
| JP | 2002-312833 | 10/2002 |
| JP | 2003-233857 | 8/2003 |
| JP | 2004-110132 | 4/2004 |
| JP | 2008-191861 | 8/2008 |

OTHER PUBLICATIONS

Japanese Office Action with English Translation (Application No. 2009-070601) (5 pages—dated Jul. 12, 2013).

* cited by examiner

MONEY HANDLING MACHINE

FIELD OF THE INVENTION

The present invention relates to a money handling machine configured to store therein money, such as banknotes, coins or the like, put into a casing from the exterior thereof. It is noted that the term "money" may be used herein for expressing either of the banknotes and coins.

BACKGROUND ART

In the past, as the money handling machine adapted for storing therein the money, such as the banknotes, coins or the like, one machine as disclosed in JP2002-312833A (Patent Document 1) or JP2004-145600A (Patent Document 2) has been known. The money handling machine of this type is designed to be installed in a store, such as a retail store or the like, and is adapted for allowing the money related to sales proceeds in the store to be deposited in the machine. Further, this money handling machine is adapted for allowing fund money for change (or change fund) expected to be used in each register during the next business time to be dispensed from the machine, after the business time is ended in the store or the like.

The Patent Document 1 discloses a money deposit/dispense system that includes a deposit/dispense machine including a recycling storing unit adapted for storing therein cash managed on the side of the store as well as adapted for performing a deposit/dispense process for the cash, and a cassette storing unit adapted for storing therein the cash. More specifically, the recycling storing unit is managed on the side of the store, while the cassette storing unit is managed by a money collector (i.e. money collecting company) in charge of collecting the sales proceeds. In this money deposit/dispense system disclosed in the Patent Document 1, the cash put into the deposit/dispense machine is stored in the recycling storing unit. Then, the cash is fed from the recycling storing unit to the cassette storing unit. Thus, the cash is delivered from the store to the money collector. In this case, the cash stored in the recycling storing unit is managed as the fund money for change or (change fund), while the cash stored in the cassette storing unit is managed as the sales proceeds.

The Patent Document 2 discloses a recycling banknote deposit/dispense machine. In this recycling banknote deposit/dispense machine disclosed in the Patent Document 2, a depositing process for counting and recognizing the money put into the casing via a deposit unit, and then escrowing the money in an escrow unit, and thereafter identifying an operator, and finally storing the money escrowed in the escrow unit, in a plurality of stackers respectively placed in a safe, for each denomination, and a dispensing process for dispensing the money, corresponding to a designated amount of money or number for each denomination are performed, respectively. In this case, the money stored in the storing unit is managed under management authority of the money collector in charge of collecting the sales of proceeds.

PRIOR ART DOCUMENTS

Patent Document 1: JP2002-312833A
Patent Document 2: JP2004-145600A

DISCLOSURE OF THE INVENTION

As described above, after the business time is ended in the store or the like, the money, such as the banknotes, coins or the like, collected from each register is counted in the money handling machine, and the fund money for the change expected to be used in each register during the next business time is prepared. Meanwhile, the money related to the sales proceeds is delivered to the money collector in charge of collecting the sales proceeds.

In the money handling machine as disclosed in the above Patent Documents 1 and 2, the operator starts the operation for the dispensing process, once the depositing process for the money is ended, or otherwise the operator starts the operation for the depositing process, once the dispensing process for the money is ended. Therefore, the operator has to wait the end of a first process performed in the money handling machine before this operator starts a second process in the same money handling machine. However, in the case the operator has to perform many operations in a short time, as in the case after the business time is ended, such a work requiring so much waiting time may rather deteriorate the working efficiency. Of course, it is possible for the operator to perform another operation after the operation for the first process is started, and then start the operation for the second process after the operation for the first process is ended. However, in such a case, it is necessary for the operator to perform two operations. Therefore, the operator may tend to inadvertently forget to do the operation for the second process and thus leave it undone.

Further, in the recycling banknote deposit/dispense machine disclosed in the Patent Document 2, the time for transporting or feeding the money once escrowed in the escrow unit to the stackers for each denomination should be required. This operation increases the time required for the depositing process for the banknotes. Therefore, in the case the dispensing process is performed once the depositing process for the banknotes is ended, the time required for handling the banknotes should be increased so much.

The present invention was made in light of the above circumstances. Therefore, it is an object to provide the money handling machine capable of performing both of the depositing process and dispensing process in one operation, and hence substantially reducing the waiting time of the operator required between the two processes, as well as securely preventing the operator from inadvertently forgetting to do the operation for the second or dispensing process and thus leaving it undone.

The money handling machine of the present invention is adapted for handling the money and includes: a casing; an insertion unit configured to allow the money to be put into the casing from the exterior thereof; a dispensing unit configured to dispense the money present in the casing to the exterior of the casing; a transport unit provided in the casing, connected with each of the insertion unit and dispensing unit, and configured to transport the money in the casing; a recognition unit provided to the transport unit and configured to recognize the money put into the casing from the exterior thereof via the insertion unit; a storing unit connected with the transport unit in the casing, and configured to store therein the money fed from the transport unit and feed the money stored therein to the transport unit; an escrow unit connected with the transport unit in the casing, and configured to escrow the money put into the casing from the exterior thereof via the insertion unit and then recognized by the recognition unit; and a control unit configured to control the insertion unit, the transport unit, the storing unit and the escrow unit, and a predetermined amount of fund money that is the money to be dispensed is set in the control unit, and the control unit serves to automatically perform a dispensing process for feeding the money corresponding to the predetermined amount of the fund money from the storing unit to the dispensing unit, after the control unit serves to perform a depositing process for taking the money into the casing from the exterior thereof via the insertion unit, and then feeding the money taken in the casing to the escrow unit. As used herein, the "predetermined amount of the fund money that is the money to be dispensed" means predetermined denominations and the number for each denomination or predetermined total amount of the fund money.

According to this money handling machine, the predetermined amount of the fund money that is the money to be dispensed, such as the change or the like (i.e., the predetermined denominations and number for each denomination or predetermined total amount of the fund money) is set in the control unit. This control unit serves to automatically perform the dispensing process for feeding the money corresponding to the predetermined amount of the fund money from the storing unit to the dispensing unit, after the control unit serves to perform the depositing process for taking the money into the casing from the exterior thereof via the insertion unit, and then feeding the money taken in the casing to the escrow unit. Therefore, the dispensing process for the money corresponding to the predetermined amount of the money set in the control unit can be performed, automatically, after the depositing process for the money is performed. Thus, the operator can perform both of the depositing process and dispensing process for the money in one operation. As such, the waiting time of the operator required between the two processes can be substantially reduced, as well as the risk that the operator may inadvertently forget to do the operation for the dispensing process and thus this dispensing process may be left undone can be securely eliminated.

In the money handling machine of this invention, it is preferred that the control unit serves to automatically perform a storing process for feeding the money from the escrow unit to the storing unit, after the control unit serves to perform the dispensing process. With this operation, the dispensing process can be performed before the storing process, unlike the case in which the dispensing process is performed after the money taken in the casing from the exterior thereof via the insertion unit is fed to the escrow unit and then fed to the storing unit from the escrow unit. Thus, the operator can take out the fund money, such as the change or the like, more rapidly, from the casing. Further, in this case, since the storing process is automatically performed after the dispensing process, the risk that the operator may inadvertently forget to do the operation for the storing process and thus this storing process may be left undone can be securely eliminated.

In the money handling machine of this invention, it is preferred that the escrow unit is managed under first management authority, and the storing unit is managed under second management authority different from the first management authority, and when the money is fed from the escrow unit to the storing unit, the management authority for handling the money is shifted from the first management authority to the second management authority.

The money handling machine of the present invention is adapted for handling the money, and includes: a casing; an insertion unit configured to allow the money to be put into the casing from the exterior thereof; a dispensing unit configured to dispense the money present in the casing to the exterior of the casing; a transport unit provided in the casing, connected with each of the insertion unit and dispensing unit, and configured to transport the money in the casing; a recognition unit provided to the transport unit and configured to recognize the money put into the casing from the exterior thereof via the insertion unit; a storing unit connected with the transport unit in the casing, and configured to store therein the money fed from the transport unit and feed the money stored therein to the transport unit; and a control unit configured to control the insertion unit, the transport unit and the storing unit, and a predetermined amount of fund money that is the money to be dispensed is set in the control unit, and the control unit serves to automatically perform a dispensing process for feeding the money corresponding to the predetermined amount of the fund money from the storing unit to the dispensing unit, after the control unit serves to perform a storing process for taking the money into the casing from the exterior thereof via the insertion unit, and then feeding the money taken in the casing to the storing unit. As used herein, the "predetermined amount of the fund money that is the money to be dispensed" means the predetermined denominations and number for each denomination or predetermined total amount of the fund money.

According to this money handling machine, the predetermined amount of the fund money that is the money to be dispensed, such as the change or the like (i.e., the predetermined denominations and number for each denomination or predetermined total amount of the fund money) is set in the control unit. This control unit serves to automatically perform the dispensing process for feeding the money corresponding to the predetermined amount of the fund money from the storing unit to the dispensing unit, after the control unit serves to perform a depositing and storing process for taking the money into the casing from the exterior thereof via the insertion unit, and then feeding the money taken in the casing to the storing unit. Therefore, the dispensing process for the money corresponding to the predetermined amount of the money set in the control unit can be performed, automatically, after the depositing and storing process for the money is performed. Thus, the operator can perform both of the depositing and storing process and dispensing process for the money in one operation. As such, the waiting time of the operator required between such two processes can be substantially reduced, as well as the risk that the operator may inadvertently forget to do the dispensing process and thus this dispensing process may be left undone can be securely eliminated.

DETAILED DESCRIPTION OF THE INVENTION

First Embodiment

Figure 1:
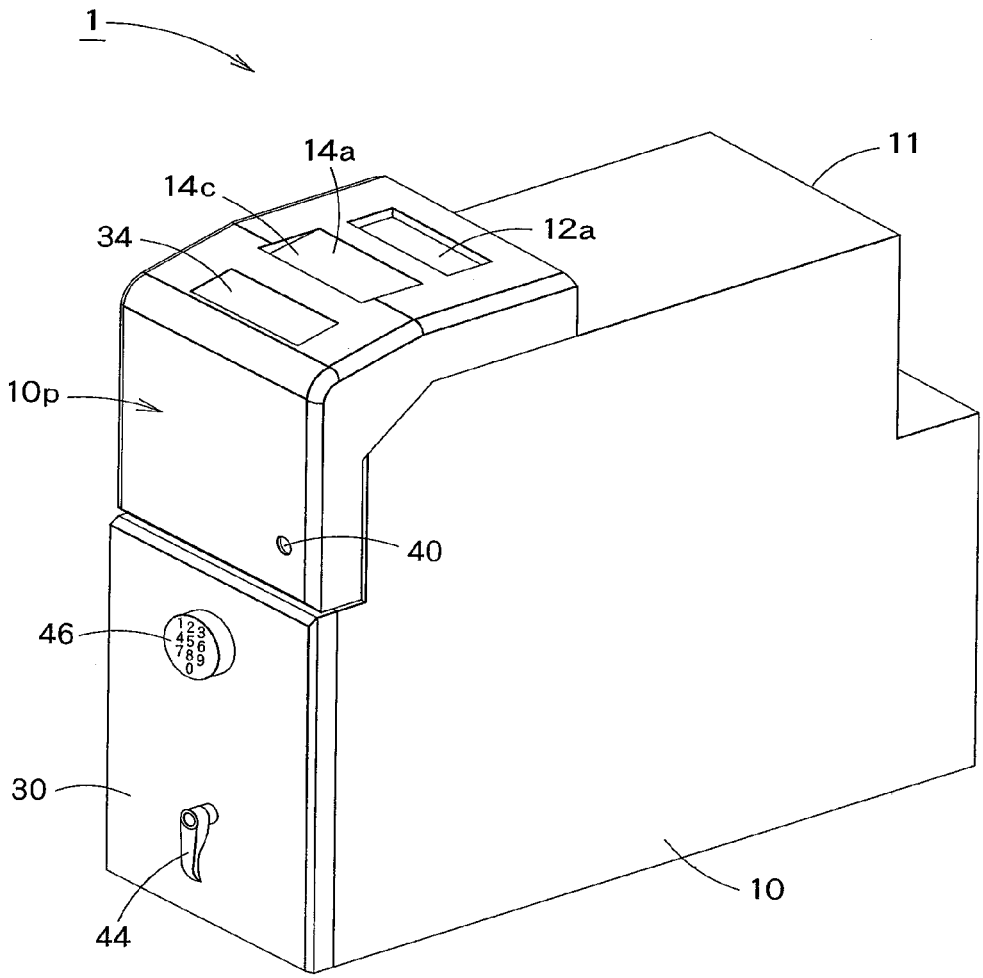
FIG. 1 is a perspective view for illustrating the construction of the money handling machine related to a first embodiment of the present invention.
Figure 2:
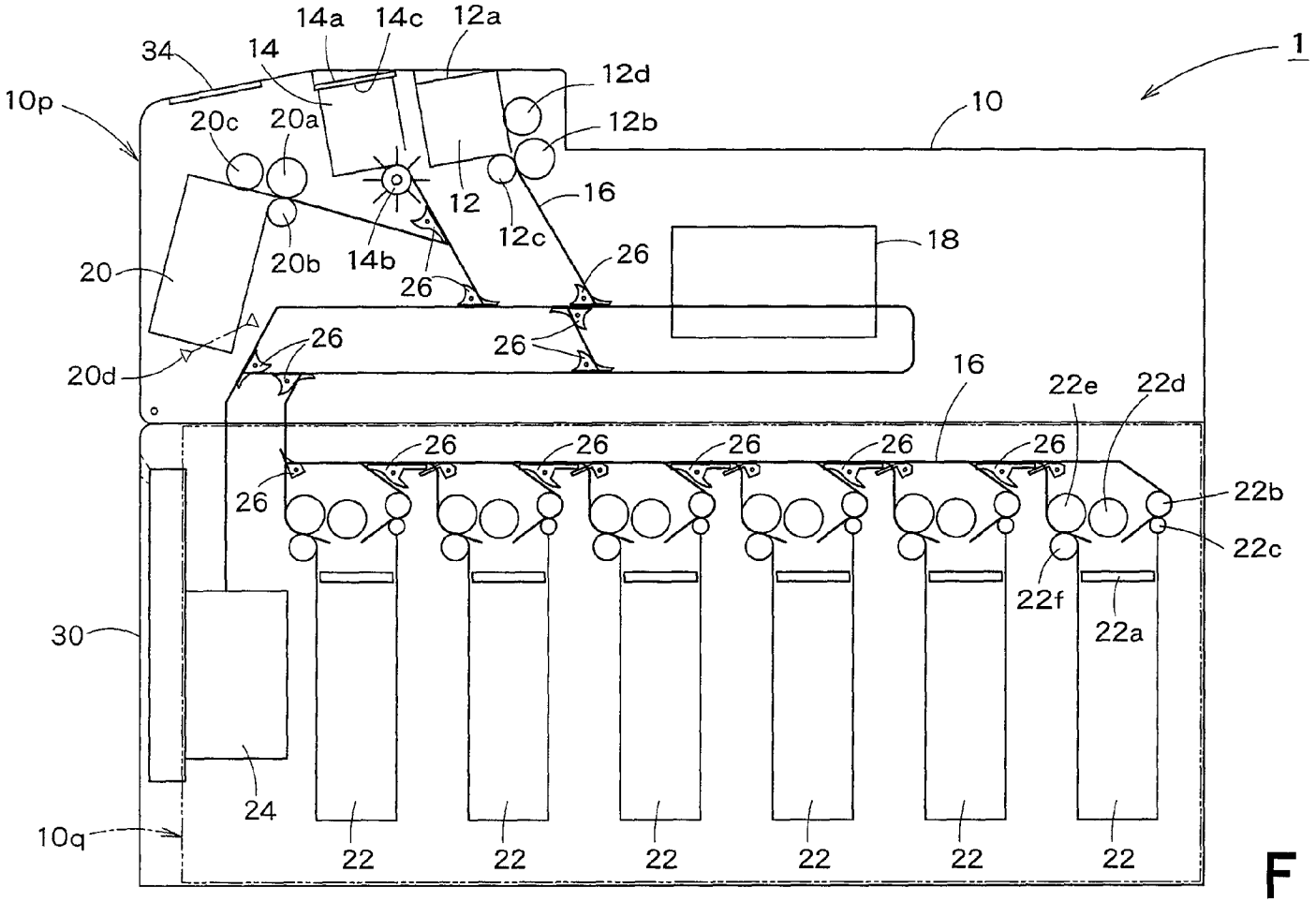
FIG. 2 is a side view for schematically illustrating the internal construction of the casing of the money handling machine shown in FIG. 1.
Figure 3:
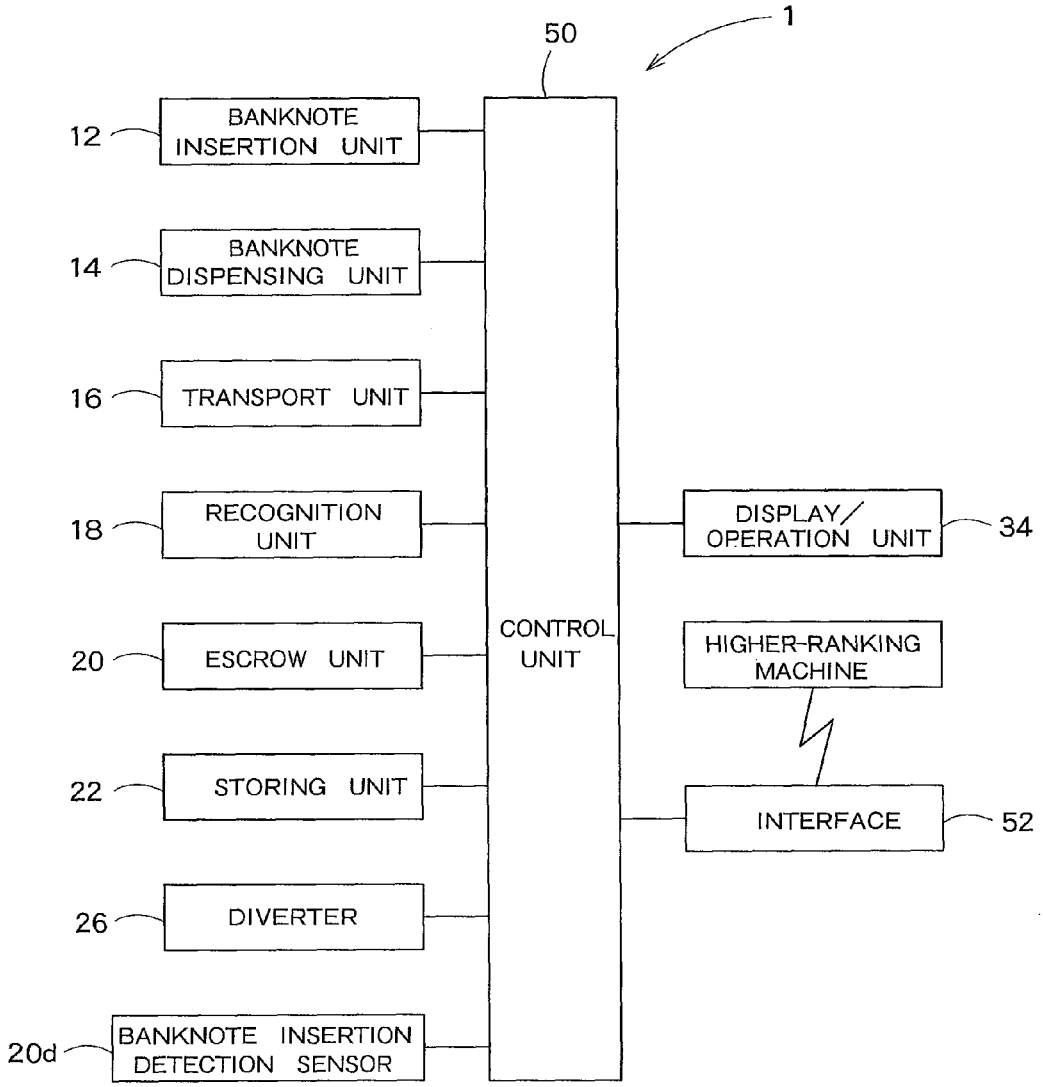
FIG. 3 is a block diagram for illustrating a control system for the money handling machine shown in FIG. 1.

Hereinafter, the money handling machine related to the first embodiment of the present invention will be described, with reference to the drawings. It is noted that the money handling machine related to this embodiment is a banknote handling machine adapted for storing the banknotes taken into the casing from the exterior thereof, in the storing unit, as well as adapted for dispensing the banknotes stored in the storing unit to the exterior of the casing. FIGS. 1 through 3 are respectively provided for illustrating the first embodiment of the money handling machine according to the present invention. Of these drawings, the perspective view of FIG. 1 illustrates the construction of the money handling machine related to this embodiment, the side view of FIG. 2 schematically illustrates the internal construction of the casing of the money handling machine shown in FIG. 1, and the block diagram of FIG. 3 illustrates the control system for the money handling machine shown in FIG. 1.

Namely, one exemplary perspective view of the banknote handling machine 1 of this embodiment is shown in FIG. 1. Now, referring to FIGS. 1 through 3, especially referring to FIG. 2, the banknote handling machine 1 will be described. As shown in these drawings, the banknote handling machine 1 includes a casing 10 having a substantially rectangular parallelepiped shape, a banknote insertion unit 12 adapted for allowing the banknotes to be put into the casing 10 from the exterior thereof, and a banknote dispensing unit 14 adapted for allowing the banknotes stored in the casing 10 to be dispensed to the exterior. Further, a transport unit 16 is provided in the casing 10. This transport unit 16 serves to transport the banknotes, respectively put into the casing 10 from the exterior thereof via an banknote insertion unit 12, in the casing 10. Further, in this casing 10, one escrow unit 20 is connected with the transport unit 16. The escrow unit 20 is adapted for escrowing therein the banknotes respectively put into the casing 10 from the exterior thereof via the banknote insertion unit 12.

Further, in the casing 10, a plurality of, for example, six, storing units 22 are connected with the transport unit 16, respectively. Each storing unit 22 is adapted for storing therein the banknotes, respectively put into the casing 10 from the exterior thereof via the banknote insertion unit 12 and then transported by the transport unit 16. Further, each storing unit 22 is adapted for feeding out the banknotes stored therein to the transport unit 16. In this case, the banknotes respectively fed out to the transport unit 16 are further fed to the banknote dispensing unit 14, such that the operator can take out the banknotes fed to the banknote dispensing unit 14. As shown in FIG. 3, a control unit 50 adapted for controlling each component of the banknote handling machine 1 is provided to the banknote handling machine 1.

Hereinafter, each component provided in the banknote handling machine 1 will be described in more detail.

The banknote handling machine 1 includes the casing 10 having the substantially rectangular parallelepiped shape. More specifically, as shown in FIG. 1, the casing 10 is provided as a vertical type casing that is relatively narrow in the width or lateral direction, relatively long in the longitudinal direction and relatively high in the vertical direction.

In the casing 10, as shown in FIG. 2, an upper unit 10*p* and a lower unit 10*q* are provided, such that the two units 10*p*, 10*q* can be pulled out, leftward in FIG. 2, from a front face (or left side face in FIG. 2) of the casing 10.

In a top face of the upper unit 10*p*, a dispensing slot or outlet 14*a* for allowing the banknotes to be dispensed from the casing 10 and an insertion slot or inlet 12*a* for allowing the banknotes to be inserted or put into the casing 10 are provided, respectively. Further, a display/operation unit 34 is provided to the top face of the upper unit 10*p*. This display/operation unit 34 serves to display the process condition or the like of the banknotes in the banknote handling machine 1 and allow the operator to input various commands to the control unit 50 of the banknote handling machine 1. In this case, the display/operation unit 34 is composed of, for example, a touch panel or the like.

Further, in a front face of the upper unit 10*p*, a unit lock 40 that can be operated by the operator is provided for locking or unlocking the upper unit 10*p*, while this unit 10*p* is being stored in the casing 10. Once this unit lock 40 is released, the upper unit 10*p* can be pulled out, leftward in FIG. 2, from the casing 10.

In addition, a door 30 that can be optionally opened and closed is attached to a lower portion in the front face of the casing 10. Further, a numeric locking mechanism 46 is provided to the door 30. This locking mechanism 46 serves to lock or unlock the door 30, while the door 30 is being closed, with the lower unit 10*q* stored in the casing 10. It is noted that the locking mechanism 46 can be operated by only a certain person in charge of collecting the money of the money collector in charge of collecting the sales proceeds. Namely, the clerk or the like on the side of the store cannot release this locking mechanism 46. Once the locking mechanism 46 is released to unlock and open the door 30, the lower unit 10*q* can be pulled out, leftward in FIG. 2, from the casing 10. Further, as shown in FIG. 1, a handle 44 for opening and closing the door 30 is provided to the door 30.

As shown in FIG. 2, in the upper unit 10*p*, a box-like banknote dispensing unit 14 and a box-like banknote insertion unit 12 are respectively provided to lower portions of the dispensing slot 14*a* and inlet 12*a*. Each of the banknote dispensing unit 14 and banknote insertion unit 12 is adapted for storing therein the banknotes, in a standing state, with the two short edges of each rectangular banknote being vertically oriented. A transparent shutter 14*c* is provided to the banknote dispensing unit 14, such that this shutter 14*c* can be optionally opened and closed. In this case, the transparent shutter 14*c* can serve to close the banknote dispensing unit 14 during the dispensing process for the banknotes and open the banknote dispensing unit 14 after the dispensing process for the banknotes is ended. With the provision of this transparent shutter 14*c*, the banknotes being respectively transported to the banknote dispensing unit 14 can be visually confirmed through the closed transparent shutter 14*c*, during the dispensing process for feeding the banknotes from the transport unit 16 to the banknote dispensing unit 14.

The banknote insertion unit 12 includes a tray (not shown) adapted for receiving the banknotes put into the banknote insertion unit 12 via the banknote inlet 12*a*, in the standing state, and a kicker roller 12*d* adapted for kicking out the banknotes, respectively pushed thereon by the tray moved upon the start of the insertion process for the banknotes, downward, one by one. Further, a feed roller 12*b* and a gate roller 12*c* are provided to the banknote insertion unit 12, respectively. In this case, the feed roller 12*b* and gate roller 12*c* respectively serve to grasp each banknote kicked out downward by the kicker roller 12*d*, and feed out the banknotes, one by one, toward the transport unit 16.

Further, a stacking wheel 14*b* for beating each banknote is provided to the banknote dispensing unit 14, so as to feed the banknotes respectively transported by the transport unit 16, into the banknote dispensing unit 14, one by one, in the standing state. In addition, a tray (not shown) is provided to the banknote dispensing unit 14, so as to receive the banknotes, respectively fed into the banknote dispensing unit 14 by the stacking wheel 14*b* for beating each banknote, in the standing state. This tray can be moved, depending on the amount of the banknotes received therein, in order to receive each banknote in a fixed position. Thus, the banknotes can be arranged and stacked forward in the tray, while keeping the standing state.

Further, as shown in FIG. 2, the escrow unit 20 is provided in the upper unit 10*p*. This escrow unit 20 can serve to escrow (or temporarily hold) the banknotes, respectively taken into the casing 10 from the exterior thereof via the banknote insertion unit 12 and then transported by the transport unit 16, collectively, in a mixed state of the denominations thereof. More specifically, the escrow unit 20 is adapted for receiving the banknotes respectively fed from the transport unit 16, one by one, and then escrowing (or temporarily holding) such fed banknotes, collectively, in a stacked condition. Further, this escrow unit 20 can serve to feed out the banknotes escrowed (or temporarily held) therein, one by one, toward the transport unit 16.

Additionally, as shown in FIG. 2, a kicker roller 20*c* is provided to the escrow unit 20. This kicker roller 20*c* is adapted for kicking out the banknotes, respectively stored, in the stacked condition, in the escrow unit 20, toward the transport unit 16, one by one, successively, from the uppermost banknote. Further, a feed roller 20*a* and a gate roller 20*b* are provided to the escrow unit 20, respectively. In this case, the feed roller 20*a* and gate roller 20*b* respectively serve to grasp each banknote kicked out by the kicker roller 20*c*, and feed out the banknotes, one by one, toward the transport unit 16.

Further, a banknote insertion detection sensor 20*d* adapted for detecting that the banknote is put or inserted into the escrow unit 20 is provided to the escrow unit 20. When this banknote insertion detection sensor 20*d* detects that the banknote is inserted into the escrow unit 20, this detection information is sent to the control unit 50.

Additionally, the transport unit 16 adapted for transporting the banknotes in the casing 10 is provided in this casing 10. This transport unit 16 serves to transport the banknotes, respectively fed out from the banknote insertion unit 12 toward the transport unit 16, one by one, along a transport path, to the escrow unit 20, storing unit 22, reject box 24 or the like. Further, the transport unit 16 can serve to feed the banknotes, respectively escrowed in the escrow unit 20, one by one, to the banknotes dispensing unit 14, storing unit 22 or the like. Furthermore, the transport unit 16 can serve to feed the banknotes, respectively stored in the storing unit 22, one by one, to the banknote dispensing unit 14 or the like. This transport unit 16 is composed of, for example, a proper combination of circular belt mechanisms, such that the transport direction of the banknotes along the transport path can be optionally changed in both of the forward and backward directions.

Further, as shown in FIG. 2, diverters 26 are provided, respectively, at points where the transport path in the transport unit 16 is bifurcated. As such, the route, along which the banknotes are respectively transported, can be switched by each diverter 26. The switching operation of the transport route for the banknotes performed by each diverter 26 is controlled by the control unit 50 that will be described later.

Additionally, as shown in FIG. 2, a recognition unit 18 is provided to the transport path in the transport unit 16. For instance, this recognition unit 18 serves to recognize the banknotes, one by one, about the denomination, authenticity, fitness or the like thereof, once the banknotes are fed out, one by one, to the transport unit 16 from the banknote insertion unit 12. The recognition result on each banknote recognized by the recognition unit 18 is sent to the control unit 50 that will be described later.

Further, as shown in FIG. 2, the reject box 24 adapted for storing therein reject banknotes is fixedly positioned in a front region of the lower unit 10*q* in the casing 10. Further, in a region of the lower unit 10*q* positioned backward relative to the reject box 24, the plurality of, for example, six, storing units 22, respectively adapted for storing therein the banknotes, for example, for each denomination thereof, are fixedly arranged in the longitudinal direction. The reject box 24 and each storing unit 22 are connected with the transport unit 16, respectively.

In each storing unit 22, a stacking table 22*a* adapted for stacking thereon the banknotes is provided to be optionally lifted and lowered in the vertical direction. Each stacking table 22*a* is provided for placing thereon the banknotes in the stacked condition.

Further, as shown in FIG. 2, each storing unit 22 includes feed rollers 22*b*, 22*c*, respectively adapted for feeding the banknotes onto the stacking table 22*a* from the transport unit 16 when the banknotes are stored in the storing unit 22, a kicker roller 22*d* adapted for kicking out the banknotes stacked on the stacking table 22*a*, one by one, when the banknotes stored in the storing unit 22 are fed out from the storing unit 22, and a feed roller 22*e* and a gate roller 22*f* respectively adapted for feeding out each banknote fed out by the kicker roller 22*d* toward the transport unit 16. In this case, since the level or height of the banknotes is increased each time the banknotes are stored and stacked on the stacking table 22*a* when the banknote are stored in each storing unit 22, the stacking table 22*a* is lowered each time the banknotes are stacked. Meanwhile, when the banknotes stored in each storing unit 22 are fed out from the storing unit 22, the stacking table 22*a* is elevated in order to press the banknotes against the kicker roller 22*d*, so that the banknotes can be fed out, one by one, toward the feed roller 22*e* and gate roller 22*f*, with the rotation of the kicker roller 22*d*.

The reject box 24 is provided for receiving the reject banknotes, such as the banknotes, not respectively recognized as normal banknotes by the recognition unit 18, or banknotes that cannot be recognized by the recognition unit 18, respectively fed from the transport unit 16. Such reject banknotes are stacked in this reject box 24, in the mixed state of the denomination thereof.

As shown in FIG. 3, the control unit 50 is connected with each component of the banknote handling machine 1, e.g., the banknote insertion unit 12, banknote dispensing unit 14, transport unit 16, recognition unit 18, escrow unit 20, respective storing units 22, respective diverters 26, banknote insertion detection sensor 20*d* and display/operation unit 34. Further, the control unit 50 is provided for receiving the information sent from the recognition unit 18. This information is related to the recognition result on each banknote recognized by the recognition unit 18. In addition, the control unit 50 is provided for receiving the various commands respectively inputted thereto by the operator via the display/operation unit 34. Furthermore, this control unit 50 can serve to control each of the banknote insertion unit 12, banknote dispensing unit 14, transport unit 16, escrow unit 20, respective storing units 22, respective diverters 26 and display/operation unit 34. It is noted that the method for controlling each component under the control of the control unit 15 will be described later.

Further, as shown in FIG. 3, the control unit 50 is connected with an interface 52, and this interface 52 is connected with a higher-ranking machine. Thus, the control unit 50 can serve to transmit and receive the signal relative to the higher-ranking machine.

Next, the operation of the banknote handling machine 1 constructed as described above will be discussed. It is noted that the operation of the banknote handling machine 1 as will be described later is performed, by controlling each component of this banknote handling machine 1 under the control of the control unit 50.

First, the operator inputs a command for setting a mode with the depositing process and dispensing process, as a process mode for the banknote, to the control unit 50, via the display/operation unit 34. More specifically, when the operator selects a depositing mode via the display/operation unit 34, a "CHANGE DISPENSE" key is displayed on a display screen in the depositing mode of the display/operation unit 34. Thereafter, when the operator pushes down the "CHANGE DISPENSE" key on the display screen in the depositing mode, the mode with the depositing process and dispensing process is selected. Further, on the display screen in the depositing mode of the display/operation section 34, a "TRANSACTION ACCEPT•END" key is also displayed. Namely, the "CHANGE DISPENSE" key and "TRANSACTION ACCEPT•END" key are respectively displayed on the same screen of the display/operation unit 34. Otherwise, when the operator selects a dispensing mode via the display/operation unit 34, a "DEPOSIT" key is displayed on the display screen in the dispensing mode of the display/operation unit 34. Thereafter, when the operator pushes down the "DEPOSIT" key on the display screen in the dispensing mode, the mode with the depositing process and dispensing process is selected. Of course, the operator may input any other suitable command for performing another process mode (e.g., for performing only the depositing process), than the mode with the depositing process and dispensing process, to the control unit 50.

In the case the mode with the depositing process and dispensing process is set, as the process mode for handling the banknotes, in the control unit 50, the operator inputs the amount of the fund money that is the money to be dispensed as the change or the like (i.e., the denominations and number for each denomination or total amount of the fund money) to the control unit 50 via the display/operation unit 34. Then, such input contents are respectively set in the control unit 50. In this case, however, the amount the money of the fund money may be set, in advance, in the control unit 50, in order to eliminate the need for the operator to input the amount of the fund money, via the display/operation unit 34, each time the operation of the money handling machine 1 is performed. Further, in this case, such a command may be transmitted to the control unit 50 from the higher-ranking machine via the interface 52, in place of being inputted to the control unit 50 by the operator via the display/operation unit 34.

Thereafter, the operator puts the banknotes, in the mixed state of the denominations of money, into the banknote insertion unit 12 via the inlet 12*a*. Then, the banknotes put into the banknote insertion unit 12 are fed out, one by one, to the transport unit 16, and then fed to the recognition unit 18 by the transport unit 16. Thereafter, the banknotes are recognized, one by one, by the recognition unit 18, about the denomination, authenticity, fitness or the like thereof. As a result, the normal banknotes, among the banknotes respectively recognized by the recognition unit 18, are fed to the escrow unit 20, and escrowed or temporality held in this escrow unit 20. Meanwhile, the banknotes that cannot be recognized by the recognition unit 18 or banknotes that are judged as abnormal banknotes by the recognition unit 18 are respectively fed, as the reject banknotes, to the banknote dispensing unit 14. During this depositing process for the banknotes, the transparent shutter 14*c* is closed. Once the transportation of the banknotes from the banknote insertion unit 12 to the escrow unit 20 or banknote dispensing unit 14 is ended, the transparent shutter 14*c* is automatically opened. Then, the operator takes out the reject banknotes from the banknote dispensing unit 14, and in some cases, puts again such banknotes into the banknote insertion unit 12.

Further, once the transportation of the banknotes from the banknote insertion unit 12 to the escrow unit 20 or banknote dispensing unit 14 is ended, the banknotes, corresponding to the number for each denomination or total amount of the fund money set in the control unit 50, are automatically fed to the banknote dispensing unit 14 from each storing unit 22 by the transport unit 16. More specifically, the banknotes stored in each storing unit 22 are fed out, one by one, to the transport unit 16, and then transported, one by one, by the transport unit 16. In this case, the banknotes fed out by the transport unit 16 are respectively transported through the recognition unit 18, and then the banknotes respectively recognized as the normal banknotes by the recognition unit 18 are fed to the banknote dispensing unit 14, while the banknotes respectively recognized as the abnormal banknotes are fed to the reject box 24. During this dispensing process for the banknotes, the transparent shutter 14*c* is closed. Thereafter, when the transportation for the banknotes from each storing unit 22 to the banknote dispensing unit 14 or reject box 24 is ended, the transparent shutter 14*c* is automatically opened, so that the operator can take out the banknotes fed in the banknote dispensing unit 14, as the fund money for the change or the like.

In the dispensing process as described above, the display/operation unit 34 serves to display the number for each denomination and/or total amount of money of the banknotes, as the fund money for the change or the like, fed from each storing unit 22 to the banknote dispensing unit 14, in a count-up (or adding) display manner. Otherwise, the display/operation unit 34 may serve to display the number for each denomination and/or total amount of money of the banknotes, as the fund money for the change or the like, in a count-down (or subtracting) display manner. Namely, in this count-down display manner, a predetermined number for each denomination and/or predetermined total amount of money of the fund money set in advance in the control unit 50 is first displayed, and then each value that is obtained by subtracting the number or amount of money of the banknotes actually fed from each storing unit 22 to the banknote dispensing unit 14, from the predetermined number for each denomination or total amount of money is displayed, on the display/operation unit 34. In this case, for a certain denomination, if the number of the banknotes actually fed from each storing unit 22 to the banknote dispensing unit 14 is insufficient for the predetermined number of the fund money set in advance in the control unit 50 or if the total amount of money of the banknotes actually fed from each storing unit 22 to the banknote dispensing unit 14 is insufficient for the predetermined total amount of the fund money set in advance in the control unit 50, some indication for indicating this condition will be displayed on the display/operation unit 34.

Alternatively, for a certain denomination, if the number of the banknotes stored in one storing unit 22 corresponding to the certain denomination is insufficient for the predetermined number of the fund money set in advance in the control unit 50, the banknotes of a smaller denomination stored in another storing unit 22 can be substituted for such insufficient banknotes. For instance, if the number of five-thousand-yen banknotes actually stored in one storing unit 22 provided for storing therein the five-thousand-yen banknotes is insufficient for the predetermined number of the fund money set in advance in the control unit 50, one-thousand-yen banknotes stored in another storing unit 22 provided for storing therein the one-thousand-yen banknotes can be transported to the banknote dispensing unit 14, as the fund money, in place of the five-thousand-yen banknotes, in order to prevent the total amount of the fund money in the banknote dispensing unit 14 from being insufficient. In regard to such substitution for the insufficient banknotes concerning the fund money, whether or not the substitution is performed can be set in advance via the display/operation unit 34.

Once the transportation of the banknotes from each storing unit 22 to the banknote dispensing unit 14 or reject box 24 is ended, the banknotes escrowed in the escrow unit 20 will be automatically fed out, one by one, to the transport unit 16, and recognized again by the recognition unit 18, and then stored in each storing unit 22 for each denomination. In this case, the escrow unit 20 is managed under the management authority provided on the side of the store (or first management authority), while each storing unit 22 is managed under the management authority provided on the side of the person in charge of collecting the money (or second management authority). Therefore, by performing such a storing process for the banknotes as described above, the management authority for handling the banknotes is shifted from the side of the store to the side of the person in charge of collecting the money.

As described above, according to the banknote handling machine 1 of this embodiment, the predetermined amount of the fund money that is the money to be dispensed as the change or the like (i.e., the predetermined denominations and number for each denomination or predetermined total amount of the fund money) is set in the control unit 50. In this case, the control unit 50 serves to perform the depositing process for first taking the banknotes into the casing 10 from the exterior thereof via the insertion unit 12, and then feeding such banknotes taken into the casing 10 to the escrow unit 20, and thereafter perform, automatically, the dispensing process for feeding the banknotes, corresponding to the predetermined amount of the money set as the fund money to be dispensed, from each storing unit 22 to the banknote dispensing unit 14. In this way, the dispensing process for the banknotes, corresponding to the predetermined amount of the money set in the control unit 50, can be automatically performed after the depositing process for the banknotes is performed. Thus, the operator can perform both of the depositing process and dispensing process for the banknotes, in one operation, via the display/operation unit 34. Therefore, the waiting time of the operator required between the two processes can be substantially reduced, as well as the risk that the operator may inadvertently forget to do the dispensing process and thus this dispensing process may be left undone can be eliminated.

In addition, after the dispensing process is performed, the control unit 50 serves to automatically perform the storing process (or delivery process) for feeding the banknotes from the escrow unit 20 to each storing unit 22. Therefore, unlike the case in which the dispensing process for the banknotes is performed after the banknotes taken into the casing 10 from the exterior thereof via the banknote insertion unit 12 are fed to the escrow unit 20 and then fed from the escrow unit 20 to each storing unit 22, the dispensing process can be performed before the storing process. As such, the operator can take out the fund money for the change or the like, more rapidly, to the exterior of the casing 10. Further, in this case, since the storing process is performed, automatically, after the dispensing process, the risk that the operator may inadvertently forget to do the storing process and hence this storing process may be left undone can be eliminated. Further, when the storing process (or delivery process) is performed as described above, the management authority for managing the banknotes is shifted from the side of the store to the side of the person in charge of collecting the money.

It should be noted that the money handling machine of this embodiment is not limited to the above aspect, and various modification or variations can be made thereto. For instance, the money handling machine according to this embodiment may also be applicable for handling the coins. In this case, a coin escrow unit is provided in the casing, for escrowing (or temporarily holding) the coins that have been put into the casing from the exterior thereof via the insertion unit or the like and then recognized by the recognition unit or the like.

Further, in the case the amount of the fund money (i.e., the denominations and number for each denomination or total amount of the fund money) is set in advance in the control unit 50 and in which the mode with the depositing process and dispensing process is inputted, as the process mode for the banknotes, to the control unit 50, if the number of the banknotes stored in one storing unit 22 corresponding to a certain denomination is insufficient for the predetermined number of the fund money set in advance in the control unit 50 or if the total amount of money of the banknotes stored in each storing unit 22 is insufficient for the predetermined total amount of the fund money set in advance in the control unit 50, the "CHANGE DISPENSE" key may not be displayed.

Further, in the control unit 50, the dispensing process for the banknotes may be definitely set to be performed together with the depositing process for the banknotes. In this case, even in the case the operator selects the depositing mode via the display/operation unit 34, if the "CHANGE" key has not been pushed down on the display screen in the depositing mode of the display/operation unit 34 upon the selection of the depositing mode, the "TRANSACTION ACCEPT•END" key is not displayed. Further, in this case, when the operator pushes down the "TRANSACTION ACCEPT•END" key after the depositing process for the banknotes and the following dispensing process are respectively performed, the transaction for the depositing process and dispensing process will be accepted, and a series of operations for the two processes will be ended.

Figure 8:
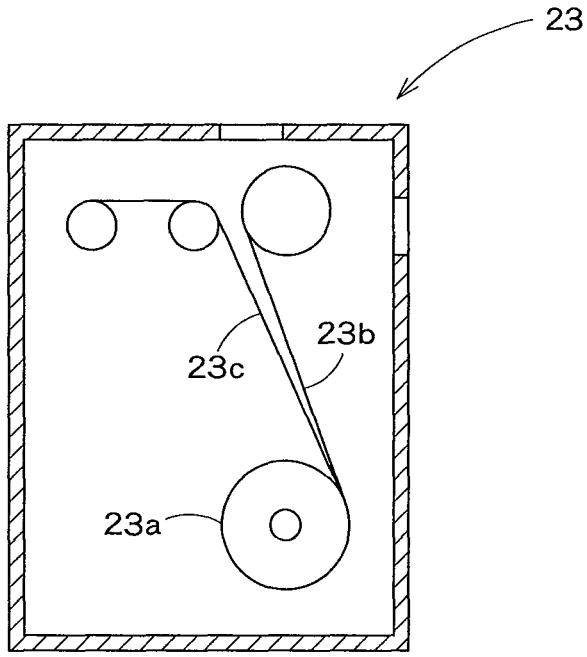
FIG. 8 is a side view for illustrating another construction of the storing unit.

Further, in this embodiment, each storing unit for storing therein the banknotes is not limited to such a type, as shown in FIG. 2 and so on, that is configured for allowing the banknotes to be respectively placed, in the stacked condition, on the stacking table. For instance, each storing unit may be of a type as shown in FIG. 8. Namely, the storing unit 23 shown in FIG. 8 includes a drum 23*a* that can be optionally rotated in both of the forward and backward directions, and a pair of tapes 23*b*, 23*c*. In this case, each banknote can be wound around the drum 23*a*, together with the pair of tapes 23*b*, 23*c*, while the banknote is grasped or held between the two tapes 23*b*, 23*c*.

Additionally, in place of the banknote insertion unit 12 and banknote dispensing unit 14 provided separately from each other, the banknote insertion unit 12 and banknote dispensing unit 14 may be provided as one integrated unit.

Second Embodiment

Figure 4:
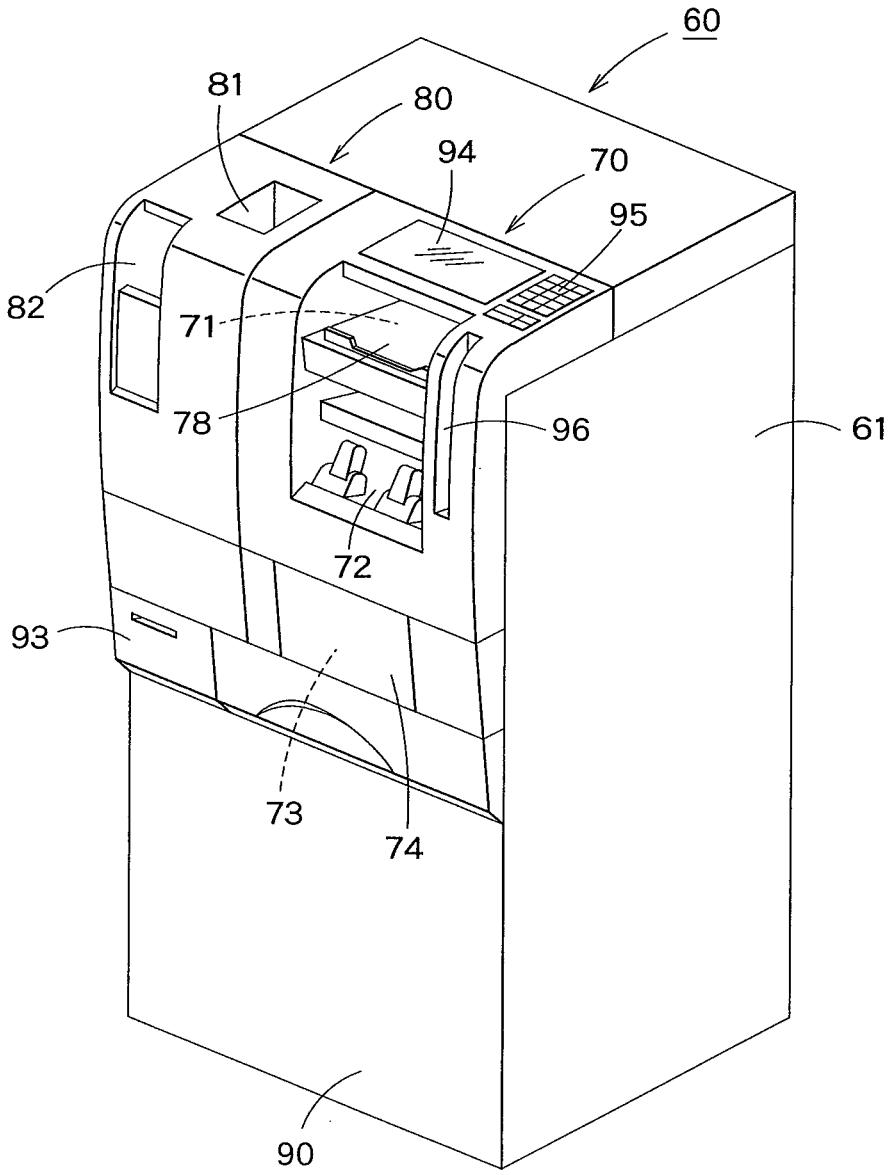
FIG. 4 is a perspective view for illustrating the construction of the money handling machine related to a second embodiment of the present invention.
Figure 5:
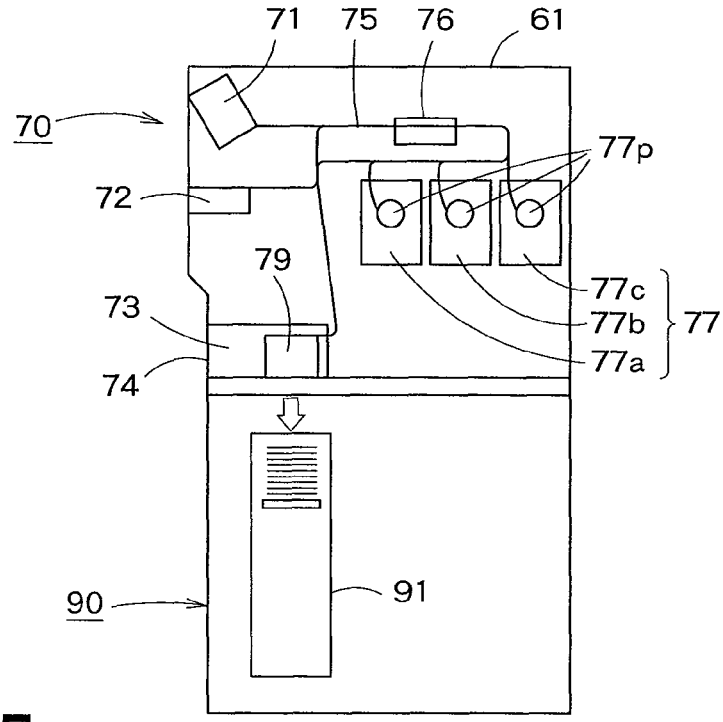
FIG. 5 is a diagram for schematically illustrating the construction of a banknote handling machine provided in the money handling machine shown in FIG. 4.
Figure 6:
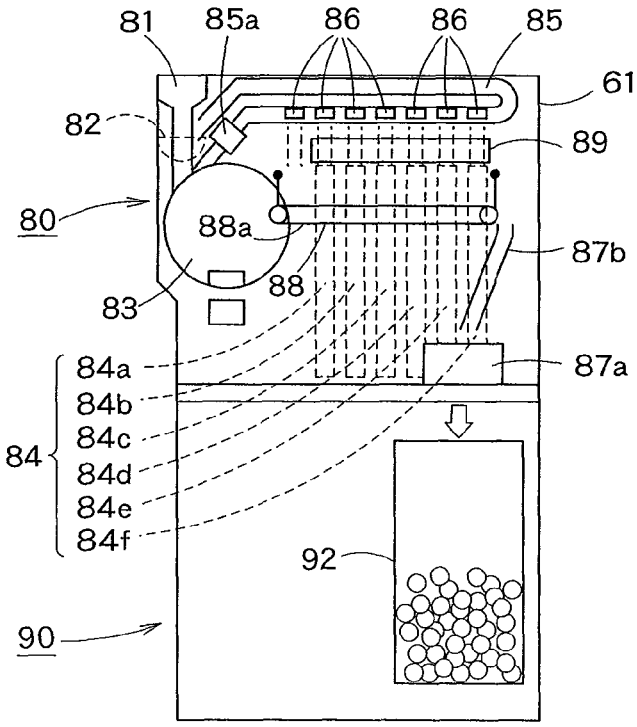
FIG. 6 is a diagram for schematically illustrating the construction of a coin handling machine provided in the money handling machine shown in FIG. 4.
Figure 7:
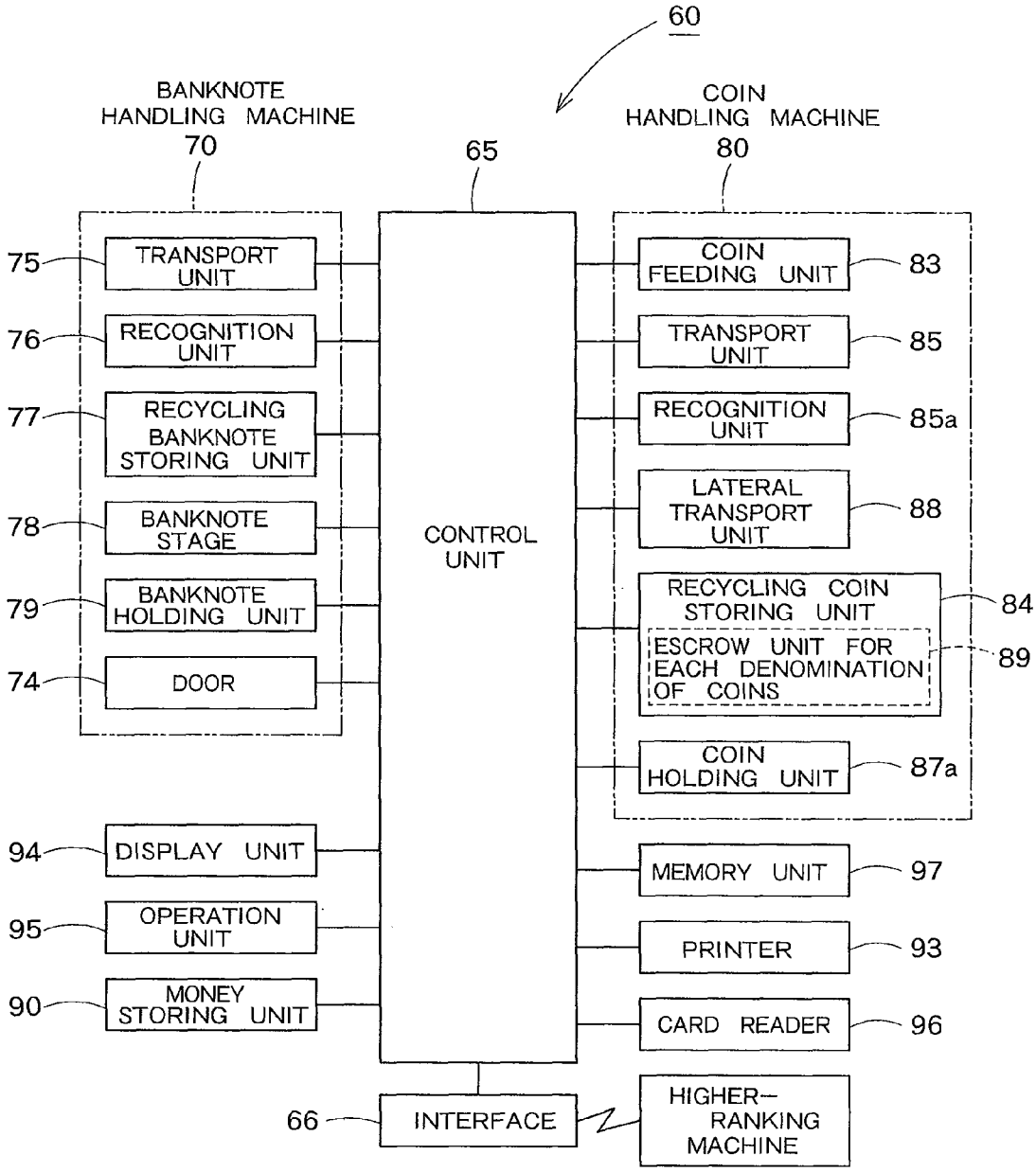
FIG. 7 is a block diagram for illustrating the control system for the money handling machine shown in FIG. 4.

Now, the money handling machine related to the second embodiment of the present invention will be described, with reference to the drawings. As will be described below, the money handling machine related to this embodiment includes the money storing unit adapted for storing therein the money, such as the banknotes, coins or the like, respectively taken in the casing from the exterior thereof. FIGS. 4 through 7 are provided for respectively illustrating the money handling machine related to the second embodiment of this invention. Of these drawings, the perspective view of FIG. 4 illustrates the construction of the banknote handling machine related to this embodiment, and FIG. 5 schematically illustrates the construction of the banknote handling machine provided in the money handling machine shown in FIG. 4. FIG. 6 schematically illustrates the construction of the coin handling machine provided in the money handling machine shown in FIG. 4, and the block diagram of FIG. 7 is provided for illustrating the control system of the money handling machine shown in FIG. 4.

As shown in FIG. 4, a money handling machine 60 includes a casing 61 having a substantially rectangular shape. In this casing 61, a banknote handling machine 70 located in an upper right portion of the money handling machine 60 when this machine 60 is seen from the front and a coin handling machine 80 located in an upper left portion of the money handling machine 60 when this machine 60 is seen from the front are provided, respectively. Further, in the casing 61 of the money handling machine 60, a money storing unit 90 adapted for storing therein the coins and banknotes is provided below the banknote handling machine 70 and coin handling machine 80. In this money handling machine 60, the banknote handling machine 70 and coin handling machine 80 are respectively managed under the management authority provided on the side of the store (or first management authority), while the money storing unit 90 is managed under the management authority provided on the side of the person in charge of collecting the money (or second management authority).

Hereinafter, each component of the banknote handling machine 70, coin handling machine 80 and money storing unit 90 will be described.

First, referring to FIGS. 4 and 5, the construction of the banknote handling machine 70 will be described. As shown in FIGS. 4 and 5, the banknote handling machine 70 includes a banknote inlet 71 provided for allowing the banknotes to be taken into the banknote handling machine 70, a banknote reject slot 72 provided for rejecting counterfeit banknotes, unrecognizable banknotes or the like, among the banknotes taken in the banknote handling machine 70, and a banknote return slot 73 provided for returning the banknotes, not respectively stored in the money storing unit 90, among the banknotes taken in the banknote handling machine 70, to the exterior of the banknote handling machine 70. Further, as shown in FIG. 5, a transport unit 75 adapted for transporting the banknotes, respectively taken in the banknote handling machine 70 via the banknote inlet 71, is provided in the banknote handling machine 70.

The banknote inlet 71 is configured for allowing one banknote or one batch of the plurality of banknotes to be collectively put or inserted in a long-edge first orientation. As shown in FIG. 4, a banknote stage 78 is provided to the banknote inlet 71. When the banknote stage 78 is in a waiting state, this stage 78 is in an elevated position, in which the operator cannot insert the banknotes through the banknote inlet 71. Meanwhile, when the banknotes are handled, the banknote stage 78 is lowered, such that the operator can insert the banknotes through the banknote inlet 71. Further, as shown in FIG. 5, the banknote inlet 71 is connected with the transport unit 75, such that one banknote or one batch of the plurality of banknotes inserted through the banknote inlet 71 can be transported, one by one, by the transport unit 75. In addition, the banknote reject slot 72 is connected with the transport unit 75, as shown in FIG. 5, such that the banknotes respectively recognized as the banknotes to be rejected or banknotes that cannot be recognized, by a recognition unit 76 that will be described later, among the banknotes taken in the banknote handling machine 70 via the banknote inlet 71, can be fed to the reject slot 72 from the transport unit 75. In this case, the operator can take out the banknotes fed to the banknote reject slot 72.

Further, as shown in FIG. 5, a banknote holding unit 79 connected with the transport unit 75 is provided to the banknote return slot 73. This banknote holding unit 79 is provided to receive and hold the banknotes respectively fed from the transport unit 75. In addition, a door 74 that can be optionally opened and closed is provided to the banknote return slot 73. In the case of returning the banknotes held in the banknote holding unit 79, a wall face of the banknote holding unit 79 located on the front face side of the machine is opened to allow the operator to take out the banknotes through the opened door 74. In this case, when the banknotes are respectively in the condition that can allow the banknotes to be taken out, the door 74 will be automatically opened. In some cases, as will be described later, the banknotes held in the banknote holding unit 79 will be fed to a banknote storing cassette 91 (that will be described later) located in the money storing unit 90, in place of being taken out from the banknote return slot 73 by the operator.

The transport unit 75 can serve to transport the banknotes, one by one, successively, in the banknote handling machine 70. More specifically, in this transport unit 75, each banknote is transported along the transport path, while being grasped or held between a pair of belts. Further, as shown in FIG. 5, the transport path provided in the transport unit 75 is bifurcated at various points, and diverters (not shown) are provided, respectively, at the same points as the respective points at which the transport path is bifurcated. Each diverter is composed of, for example, a bifurcating nail, and is controlled by a control unit 65 that will be described later. Further, a recognition unit 76 is provided to the transport unit 75. This recognition unit 76 is adapted for recognizing each banknote transported by the transport unit 75, one by one. More specifically, this recognition unit 76 can serve to recognize each banknote transported by the transport unit 75, about the denomination, authentication, fitness or the like thereof. The recognition result on each banknote recognized by the recognition unit 76 is sent to the control unit 65 that will be described later.

A plurality of (e.g., three) recycling banknote storing units 77 are arranged, in parallel to one another, in the banknote handling machine 70. In general, each of the recycling banknote storing units 77*a* to 77*c* is provided for temporarily storing therein the banknotes, for each denomination. As shown in FIG. 5, each recycling banknote storing unit 77 has a drum 77*p* that can be optionally rotated in both of the forward and backward directions. In this case, a pair of tapes are wound around each drum 77*p*. Namely, each banknote fed to one recycling banknote storing unit 77 from the transport unit 75 is wound and stored around the drum 77*p*, one by one, together with the pair of tapes, while being grasped or held between the tapes.

The banknote holding unit 79 is provided to the banknote return slot 73, as described above, and is connected with the transport unit 75, as shown in FIG. 5. This banknote holding unit 79 serves to receive the banknotes put into the banknote inlet 71 and then transported to this unit 79 by the transport unit 75, or serves to receive the banknotes stored in each recycling banknote storing unit 77 and then transported to this unit 79 by the transport unit 75. In this case, the banknotes respectively fed from the transport unit 75 can be held, in a batch form, in the banknote holding unit 79. In the case of returning the banknotes held in the banknote holding unit 79, the wall face of this unit 79 located on the front face side of the machine is opened as described above, such that the operator can take out the banknotes through the door 74. In this case, when the banknotes are respectively in the condition that can allow the banknotes to be taken out, the door 74 will be automatically opened. Meanwhile, when the banknotes are held in the holding unit 79, the banknotes are placed on an escrow plate. Further, when the banknotes held in the holding unit 79 are stored in the banknote storing cassette 91, a stage provided in the banknote storing cassette 91 is first moved to receive the banknotes placed on the escrow plate of the banknote holding unit 79. Thereafter, the banknotes are transferred and placed on the stage, and then the stage is lowered from the banknote holding unit 79 toward the banknote storing cassette 91. Then, the banknotes placed on the stage are pressed from above by a holding member, and thus stored in the banknote storing cassette 91.

Next, referring to FIGS. 4 and 6, the construction of the coin handling machine 80 will be described. As shown in FIGS. 4 and 6, the coin handling machine 80 includes a coin inlet 81 provided for allowing the coins to be taken into the coin handling machine 80, and a coin return slot 82 provided for rejecting unrecognizable coins or the like recognized by the recognition unit 85*a* that will be described later, among the coins taken in the coin handling machine 80, and returning the coins, not respectively stored in the money storing unit 90, among the coins taken in the coin handling machine 80, to the exterior of the coin handling machine 80. Further, as shown in FIG. 6, a transport unit 85 adapted for transporting the coins, respectively taken in the coin handling machine 80 via the coin inlet 81, is provided in the coin handling machine 80.

The coin inlet 81 is configured for allowing one or more coins to be collectively put into the coin handling machine 80. The coins inserted through the coin inlet 81 are respectively fed into the coin handling machine 80. The coin return slot 82 is connected with a downstream-side end of the transport unit 85, and is configured for allowing the coins fed from the transport unit 85 to be accumulated in this coin return slot 82. Thus, the operator can take out the coins accumulated in the coin return slot 82. In this case, as described above, the unrecognizable coins or the like recognized by the recognition unit 85*a* that will be described later, among the coins taken in the coin handling machine 80, and the coins, not respectively stored in the money storing unit 90, among the coins taken in the coin handling machine 80, are respectively fed to the coin return slot 82. Namely, such coins are returned to the exterior of the coin handling machine 80 via the coin return slot 82.

As shown in FIG. 6, a coin feeding unit 83 is provided in the coin handling machine 80. This coin feeding unit 83 is provided to be in communication with the coin inlet 81, and serves to temporarily accumulate therein the coins put into the coin handling machine 80 by the operator via the coin inlet 81 and then feed out such accumulated coins toward the transport unit 85.

The transport unit 85 serves to transport the coins, one by one, successively, in the coin handling machine 80. As shown in FIG. 6, an upstream-side end and the downstream-side end of the transport unit 85 are connected with the coin feeding unit 83 and coin return slot 82, respectively. Further, a recognition unit 85*a* is provided along the transport unit 85. This recognition unit 85*a* is adapted for recognizing the coins transported by the transport unit 85, one by one. In this case, the recognition unit 85*a* serves to recognize each coin transported by the transport unit 85, about the denomination, authentication and the like thereof. The recognition result on each coin recognized by the recognition unit 85*a* is sent to the control unit 65 that will be described later.

A plurality of (e.g., six) recycling coin storing units 84 are arranged, in parallel to one another, in the coin handling machine 80. Each recycling coin storing unit 84 is of a cylindrical shape and configured for taking in and taking out the coins from the top of the storing unit. Further, each recycling coin storing unit 84 extends in the vertical direction. In general, each of the recycling coin storing units 84*a* to 84*f* is provided for storing therein the coins, for each denomination.

As shown in FIG. 6, seven sorting holes 86 are arranged in the middle of the transport unit 85, with a given interval, in succession, from the coin feeding unit 83 toward the downstream side. Among such seven sorting holes 86, the sorting hole 86 (or overflow sorting hole 86) positioned on the most upstream side is provided for feeding the coins, directly, to a lateral transport unit 88 that will be described later, from the transport unit 85. More specifically, the sorting hole 86 positioned on the most upstream side serves to feed the coins onto the lateral transport unit 88, when the recognition result on the coins respectively recognized by the recognition unit 85*a* satisfies a predetermined condition (e.g., when one recycling coin storing unit 84 corresponding to a certain denomination of the coins respectively recognized by the recognition unit 85*a* is full up with such coins). The second to seventh sorting holes 86 arranged from the upstream side are respectively corresponding to the recycling coin storing units 84*a* to 84*f*.

As shown in FIG. 6, a escrow unit 89 for each denomination of the coins, which is adapted for escrowing therein the coins, is provided to an upper portion of each recycling coin storing unit 84 extending in the vertical direction. With this configuration, the coins dropped downward from the transport unit 85, via each sorting hole 86, other than the sorting hole 86 positioned on the most upstream side among the seven sorting holes 86, will be escrowed in the escrow unit 89 for each denomination of the coins. Thereafter, the coins escrowed in this escrow unit 89 for each denomination of the coins are stored in each corresponding recycling coin storing unit 84. In this case, the escrow unit 89 for each denomination of the coins includes a dispensing member, such that the coins escrowed in this escrow unit 89 can also be dispensed by the dispensing member onto the lateral transport unit 88 that will be described later. Meanwhile, in the case the coins stored in each recycling coin storing unit 84 are taken out from this recycling coin storing unit 84, a stage (not shown) provided to a lower portion of the recycling coin storing unit 84 is first lifted upward. Thus, the coins placed on this stage will be fed to the escrow unit 89 for each denomination of the coins, and then dispensed onto the lateral transport unit 88 by the dispensing member of the escrow unit 89 for each denomination of the coins.

As shown in FIG. 6, a coin holding unit 87*a* is provided in the coin handling machine 80, with a chute 87*b* being located above the coin holding unit 87*a*. With this configuration, the coins fed to a top portion of the chute 87*b* from the lateral transport unit 88 that will be described later are respectively fed to the coin holding unit 87*a* through the chute 87*b*. Then, the coins temporarily held in the coin holding unit 87*a* will be fed to a coin storing cassette 92 (that will be described later) located in the money storing unit 90.

Further, as shown in FIG. 6, the lateral transport unit 88 is provided in the coin handling machine 80. This lateral transport unit 88 is located in the vicinity of the recycling coin storing units 84 respectively extending in the vertical direction, and includes, for example, a circular belt 88*a* extending in a substantially horizontal direction. The circular belt 88*a* can be circulated in both of the clockwise and anticlockwise directions in FIG. 6. One end of the lateral transport unit 88 is positioned in the coin feeding unit 83, while the other end of the lateral transport unit 88 is positioned in the vicinity of the top portion of the chute 87*b*. In this case, when the circular belt 88*a* is rotated in the anticlockwise direction in FIG. 6, the coins placed on the lateral transport unit 88 will be fed to the coin feeding unit 83. Meanwhile, when the circular belt 88*a* is rotated in the clockwise direction in FIG. 6, the coins placed on the lateral transport unit 88 will be fed to the chute 87*b*, and finally held in the coin holding unit 87*a*.

Now, referring to FIG. 4, the construction of the money storing unit 90 will be described. As shown in FIG. 4, the money storing unit 90 is provided to a lower portion of the casing 61 of the money handling machine 60. Further, as shown in FIGS. 5 and 6, the money storing unit 90 includes the banknote storing cassette 91 provided for storing therein the banknotes and the coin storing cassette 92 provided for storing therein the coins. More specifically, the banknote storing cassette 91 is provided for storing therein the banknotes held in the banknote holding unit 79 of the banknote handling machine 70 (see FIG. 5). Meanwhile, the coin storing cassette 92 is provided for storing therein the coins held in the coin holding unit 87*a* of the coin handling machine 80 (see FIG. 6). In this case, each cassette 91, 92 of the money storing unit 90 can be pulled out forward from the casing 61 by the person in charge of collecting the money, such as the sales proceeds or the like, of the money collector. As such, each cassette 91, 92 itself can be collected by the person in charge of collecting the money.

As described above, the banknote handling machine 70 and coin handling machine 80 are managed under the management authority provided on the side of the store (or first management authority). Meanwhile, the money storing unit 90 is managed under the management authority provided on the side of the person in charge of collecting the money (or second management authority). Therefore, the various processes for the banknotes or coins, respectively stored in the recycling banknote storing units 77 provided in the banknote handling machine 70 or recycling coin storing units 84 provided in the coin handling machine 80, and access to the deposit/dispense information or money-amount data on such banknotes and coins can be performed by only the operator authorized on the side of the store. Meanwhile, the collection (or collecting process) for the banknotes or coins stored in the money storing unit 90 can be performed by only the person in charge of collecting the money of the money collector.

Next, other various mechanisms respectively provided in the money handling machine 60 will be described. As shown in FIG. 4, an operation unit 95 for allowing the operator to input the various commands to the control unit 65 (that will be described later) of the money handling machine 60, and a display unit 94 for displaying the process condition or the like concerning the money in the money handling machine 60 are respectively provided to a top face of the casing 61 of the money handling machine 60. In this case, the operation unit 95 includes numeric keys, an accept key, a start key, a clear key and a reset key, respectively provided, such that the operator can input the various commands to the control unit 65 of the money handling machine 60, by pushing such keys. For instance, the display unit 94 is composed of a liquid crystal display (LCD).

In a front face of the casing 61, a printer 93 adapted for printing the process contents or the like for the money in the money handling machine 60, and a card reader 96 used for confirming or checking the authority for operating the money handling machine 60 or the like of the operator are provided, respectively. In this case, the card reader 96 serves to read the ID information of the ID card carried by each operator.

Next, referring to FIG. 4, the control unit 65 adapted for controlling each component provided in the money handling machine 60 will be described. This control unit 65 is located in the casing 61 of the money handling machine 60.

As shown in FIG. 4, the control unit 65 is connected with each component of the banknote handling machine 70 (e.g., the transport unit 75, recognition unit 76, recycling banknote storing units 77, banknote stage 78, banknote holding unit 79, door 74 and the like), and is also connected with each component of the coin handling machine 80 (e.g., the coin feeding unit 83, transport unit 85, recognition unit 85*a*, lateral transport unit 88, recycling coin storing units 84 including the escrow unit 89 for each denomination of the coins, coin holding unit 87*a* and the like). Further, the control unit 65 is connected with the money storing unit 90, display unit 94, operation unit 95, printer 93 and card reader 96, and is also connected with a memory unit 97 and the like. In addition, the control unit 65 is connected with the higher-ranking machine via the interface 66.

This control unit 65 can serve to receive the recognition result on each banknote sent from the recognition unit 76 of the banknote handling machine 70 as well as receive the recognition result on each coin sent from the recognition unit 85*a* of the coin handling machine 80. Further, the control unit 65 can serve to receive information, such as the ID information of the operator or the like, inputted via the operation unit 95 or read from the ID card by the card reader 96.

In this case, for the operation of the money handling machine 60, the control unit 65 can serve to check the authority given to the operator, based on the ID information or the like of the operator inputted via the operation unit 95 or read from the card reader 96. In addition, the control unit 65 can serve to control each component of the banknote handling machine 70 and coin handling machine 80, as well as control the display unit 94, printer 93 and the like.

Now, a series of operations for handling the money, e.g., for storing the money, such as the banknotes, coins or the like taken in the casing 61 from the exterior thereof, in the money storing unit 90 of the money handling machine 60, as shown in FIGS. 4 through 7, will be discussed.

First, the operator inputs the command for setting the mode with the depositing process and dispensing process, as the process mode for the banknote, to the control unit 65, via the operation unit 95. Then, the operator inputs the amount of the fund money that is the money to be dispensed as the change or the like (i.e., the denominations and number for each denomination or total amount of the fund money) to the control unit 65, via the operation unit 95. In this way, such input contents will be set in the control unit 65. In this case, however, such a command may be transmitted to the control unit 65 from the higher-ranking machine via the interface 66, in place of being inputted to the control unit 65 by the operator via the operation unit 95.

Thereafter, when the operator puts the banknotes, among the money, such as the sales proceeds of the store or the like, into the banknote handling machine 70 via the banknote inlet 71, the banknotes, respectively inserted through the banknote inlet 71, are transported, one by one, by the transport unit 75, and then recognized by the recognition unit 76, about the denomination, authenticity, fitness or the like thereof. As a result, the normal banknotes, among the banknotes respectively recognized by the recognition unit 76, are fed to each recycling banknote storing unit 77. Meanwhile, the banknotes that cannot be recognized by the recognition unit 76 or banknotes that are judged as the abnormal banknotes by the recognition unit 76 are respectively fed, as the reject banknotes, to the banknote reject slot 72. Once the transportation of the banknotes from the banknote inlet 71 to each recycling banknote storing unit 77 or banknote reject slot 72 is ended, the operator takes out the reject banknotes from the banknote reject slot 72.

Then, the banknotes, corresponding to the predetermined amount of the fund money (i.e., the predetermined number for each denomination or total amount of the fund money) set in the control unit 65, will be fed to the banknote holding unit 79 from each recycling banknote storing unit 77 by the transport unit 75. More specifically, the banknotes stored in each recycling banknote storing unit 77 are fed, one by one, to the transport unit 75, and then transported, one by one, by the transport unit 75. Further, during this transportation, the banknotes fed out to the transport unit 75 are passed through the recognition unit 76. At this time, the banknotes, respectively judged as the normal banknotes by the recognition unit 76, will be fed to the banknote holding unit 79, while the banknotes, not respectively judged as the normal banknotes, will be fed to the banknote reject slot 72. Once the transportation for the banknotes from each recycling banknote storing unit 77 to the banknote holding unit 79 or banknote reject slot 72 is ended, the wall face of the banknote holding unit 79 located on the side of the front face of the machine is opened, so as to allow the operator to take out the banknotes, as the fund money for the change or the like, from the banknote holding unit 79 through the door 74.

In the dispensing process for the banknotes as described above, the display unit 94 serves to display the number for each denomination and/or total amount of money of the banknotes, as the fund money for the change or the like, fed from each recycling banknote storing unit 77 to the banknote holding unit 79, in the count-up (or adding) manner. Otherwise, the display unit 94 may serve to display the number for each denomination and/or total amount of money of the banknotes, in the count-down (or subtracting) manner, in which the predetermined number for each denomination and/or predetermined total amount of money of the fund money set in advance in the control unit 65 is first displayed, and then each value obtained by subtracting the number or amount of money of the banknotes actually fed from each recycling banknote storing unit 77 to the banknote holding unit 79, from the predetermined number for each denomination or total amount of money is displayed, on the display unit 94. In this case, for a certain denomination, if the number of the banknotes actually fed from each recycling banknote storing unit 77 to the banknote holding unit 79 is insufficient for the predetermined number of the fund money set in advance in the control unit 65 or if the total amount of money of the banknotes actually fed from each recycling banknote storing unit 77 to the banknote holding unit 79 is insufficient for the predetermined total amount of the fund money set in advance in the control unit 65, some indication for indicating this condition will be displayed on the display unit 94.

Alternatively, for a certain denomination, if the number of the banknotes actually stored in one recycling banknote storing unit 77 corresponding to the certain denomination is insufficient for the predetermined number of the fund money set in advance in the control unit 65, the banknotes of a smaller denomination stored in another recycling banknote storing unit 77 can be substituted for such insufficient banknotes. For instance, if the number of five-thousand-yen banknotes actually stored in one recycling banknote storing unit 77 provided for storing therein the five-thousand-yen banknotes is insufficient for the predetermined number of the fund money set in advance in the control unit 65, one-thousand-yen banknotes stored in another recycling banknote storing unit 77 provided for storing therein the one-thousand-yen banknotes can be transported to the banknote holding unit 79, as the fund money, in place of the five-thousand-yen banknotes, in order to prevent the total amount of the fund money in the banknote holding unit 79 from being insufficient. In regard to such substitution for the insufficient banknotes concerning the fund money, whether or not the substitution is performed can be set in advance via the operation unit 95.

Then, another case in which the operator puts the coins, among the money, such as the sales proceeds of the store or the like, into the coin inlet 81 of the coin handling machine 80 will be described. When the operator puts the coins into the coin inlet 81 of the coin handling machine 80, the coins are first fed to the coin feeding unit 83 from the coin inlet 81, and then fed out, one by one, to the transport unit 85 from the coin feeding unit 83. Thereafter, the coins are transported, one by one, by the transport unit 85, and then recognized by the recognition unit 85*a* about the denomination, authenticity, fitness or the like thereof. As a result, the normal coins, among the coins recognized by the recognition unit 85*a*, are dropped downward from the transport unit 85 via each selection hole 86, and then fed to the escrow unit 89 for each denomination of the coins. Thereafter, the coins are fed to each recycling coin storing unit 84 from the escrow unit 89 for each denomination of the coins, and then stored in the recycling coin storing units 84, for each denomination. Meanwhile, the coins that cannot be recognized by the recognition unit 85*a*, or coins that are not judged as the normal coins are fed, as reject coins, to the coin return slot 82. In this way, once the transportation for the coins from the coin feeding unit 83 to each recycling coin storing unit 84 or coin return slot 82 is ended, the operator will take out the reject coins from the coin return slot 82.

Thereafter, the coins are fed, automatically, to the lateral transport unit 88, from each recycling coin storing unit 84 through the escrow unit 89 for each denomination of the coins, corresponding to the predetermined amount of the fund money (i.e., corresponding to the predetermined number for each denomination or total amount of the fund money) set in the control unit 65, and then further fed to the coin feeding unit 83 from the lateral transport unit 88. Thereafter, the coins are fed out, one by one, to the transport unit 85 from the coin feeding unit 83, and then such fed-out coins are transported to the coin return slot 82 by the transport unit 85. In this way, once the transportation of the coins from each recycling coin storing unit 84 to the coin return slot 82 is ended, the operator will take out the coins, as the fund money for the change or the like, from the coin return slot 82.

In the dispensing process for the coins as described above, the display unit 94 serves to display the number for each denomination and/or total amount of money of the coins, as the fund money for the change or the like, fed from each recycling coin storing unit 84 to the coin return slot 82, in the count-up (or adding) manner. Otherwise, the display unit 94 may serve to display the number for each denomination and/or total amount of money of the coins, in the count-down (or subtracting) manner, in which the predetermined number for each denomination and/or predetermined total amount of money of the fund money set in advance in the control unit 65 is first displayed, and then each value obtained by subtracting the number or amount of money of the coins actually fed from each recycling coin storing unit 84 to the coin return slot 82, from the predetermined number for each denomination or total amount of money is displayed, on the display unit 94. In this case, for a certain denomination, if the number of the coins actually fed from each recycling coin storing unit 84 to the coin return slot 82 is insufficient for the predetermined number of the fund money set in advance in the control unit 65 or if the total amount of money of the coins actually fed from each recycling coin storing unit 84 to the coin return slot 82 is insufficient for the predetermined total amount of the fund money set in advance in the control unit 65, some indication for indicating this condition will be displayed on the display unit 94.

Alternatively, for a certain denomination, if the number of the coins actually stored in one recycling coin storing unit 84 corresponding to the certain denomination is insufficient for the predetermined number of the fund money set in advance in the control unit 65, the coins of a smaller denomination stored in another recycling coin storing unit 84 can be substituted for such insufficient coins. For instance, if the number of one-hundred-yen coins actually stored in one recycling coin storing unit 84 provided for storing therein the one-hundred-yen coins is insufficient for the predetermined number of the fund money set in advance in the control unit 65, ten-yen coins stored in another recycling coins storing unit 84 provided for storing therein the ten-yen coins can be transported to the coin return slot 82, as the fund money, in place of the one-hundred-yen coins, in order to prevent the total amount of the fund money in the coin return slot 82 from being insufficient. In regard to such substitution for the insufficient coins concerning the fund money, whether or not the substitution is performed can be set in advance via the operation unit 95.

According to the money handling machine 60 of this embodiment, the predetermined amount of the fund money that is the money to be dispensed as the change or the like (i.e., the predetermined denominations and number for each denomination or predetermined total amount of the fund money) is set in the control unit 65. In this case, the control unit 65 serves to perform the depositing and storing process for taking the banknotes or coins into the casing 61 from the exterior thereof via the banknote inlet 71 or coin inlet 81 and then feeding such banknotes or coins taken into the casing 61 to the banknote storing cassette 91 or coin storing cassette 92 of the money storing unit 90, and thereafter perform, automatically, the dispensing process for feeding the banknotes or coins, corresponding to the predetermined amount of the fund money, from each recycling banknote storing unit 77 or each recycling coin storing unit 84 to the banknote holding unit 79 or coin return slot 82. Thus, the dispensing process for the banknotes or coins, corresponding to the predetermined amount of the money set in the control unit 65, can be automatically performed after the depositing and storing process for the banknotes or coins is performed. Therefore, the operator can perform both of the depositing and storing process and dispensing process for the money, in one operation, via the operation unit 95. As such, the waiting time of the operator required between such two processes can be substantially reduced, as well as the risk that the operator may inadvertently forget to do the dispensing process and thus this dispensing process may be left undone can be eliminated.

In the aforementioned money handling machine 60 of this embodiment, the insertion unit and dispensing unit for the banknotes or coins are provided separately from each other in the banknote handling machine 70 or coin handling machine 80. However, such insertion unit and dispensing unit may be provided as one integrated unit.

Third Embodiment

Figure 9:
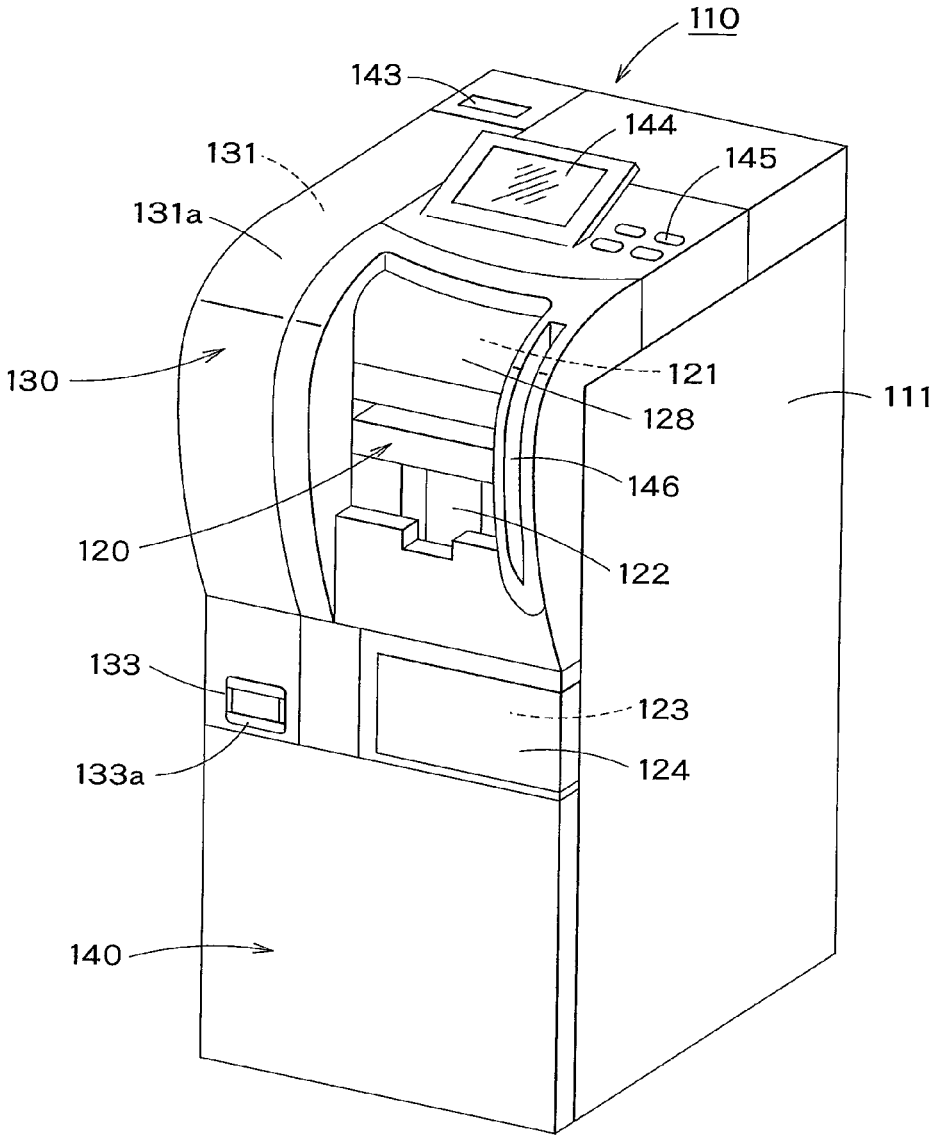
FIG. 9 is a perspective view illustrating the construction of the money handling machine related to a third embodiment of the present invention.
Figure 10:
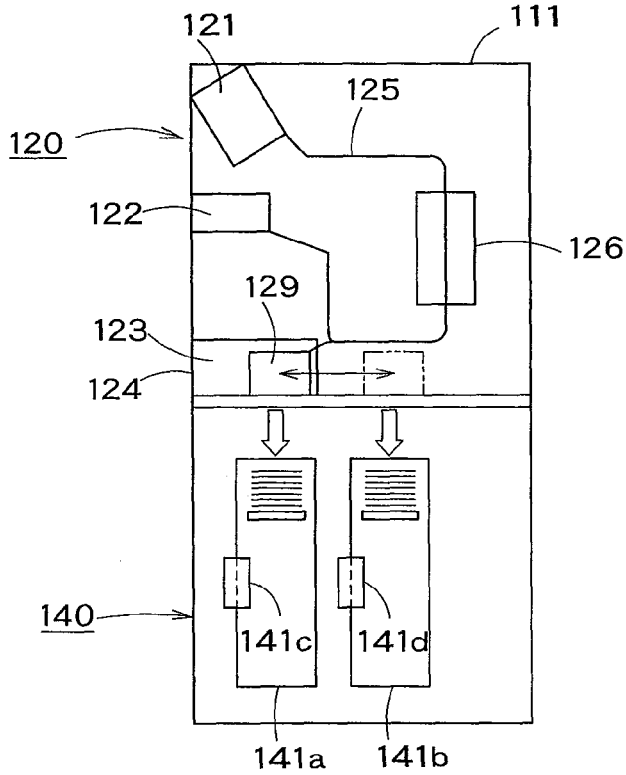
FIG. 10 is a diagram for schematically illustrating the construction of the banknote handling machine provided in the money handling machine shown in FIG. 9.
Figure 11:
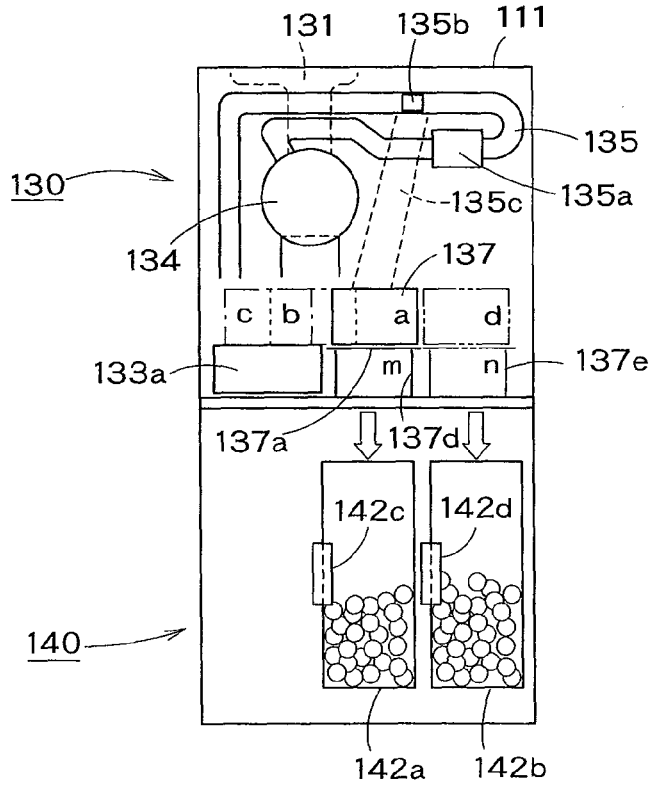
FIG. 11 is a diagram for schematically illustrating the construction of the coin handling machine provided in the money handling machine shown in FIG. 9.
Figure 12:
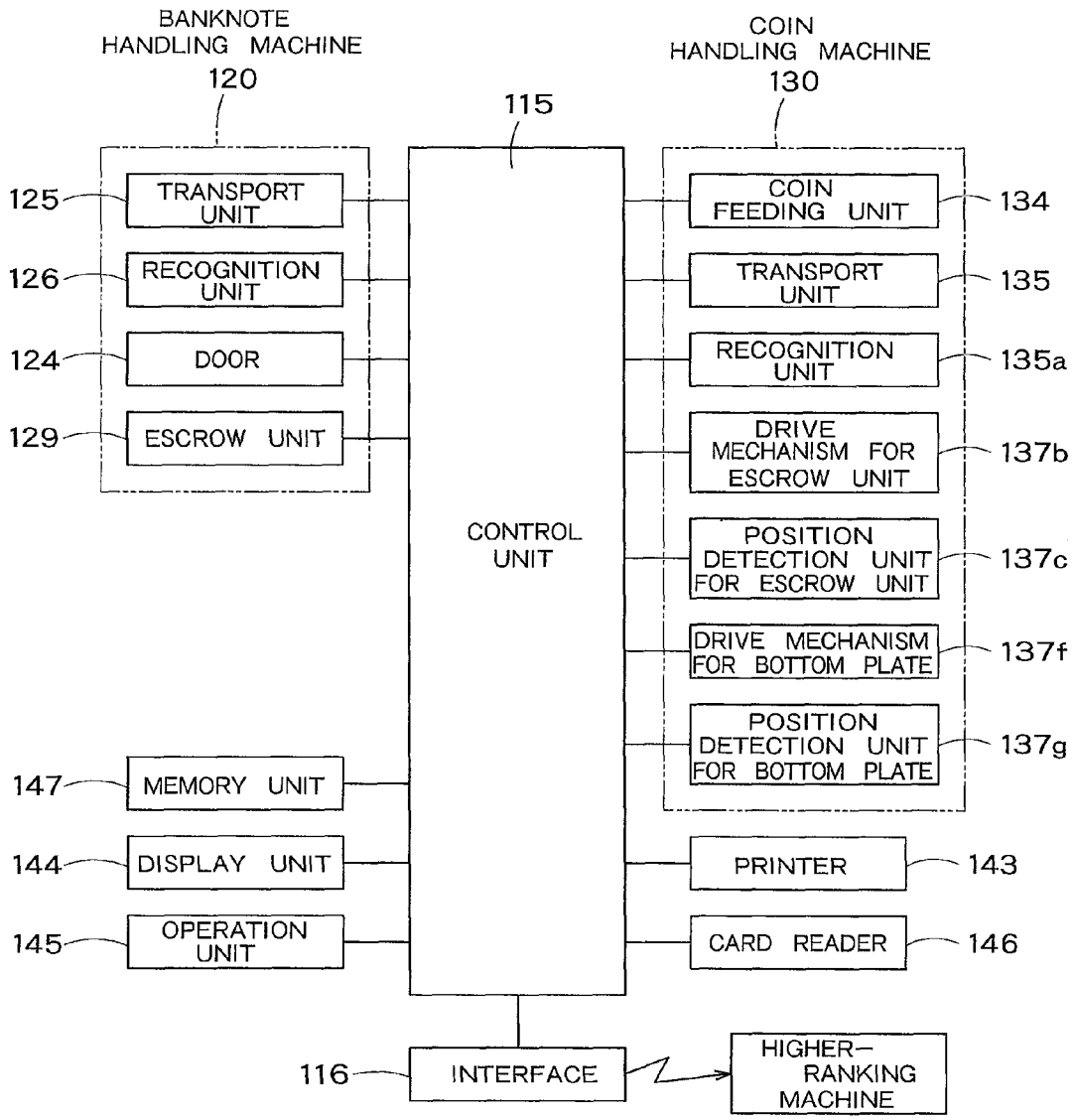
FIG. 12 is a block diagram for illustrating the control system for the money handling machine shown in FIG. 9.
Figure 13:
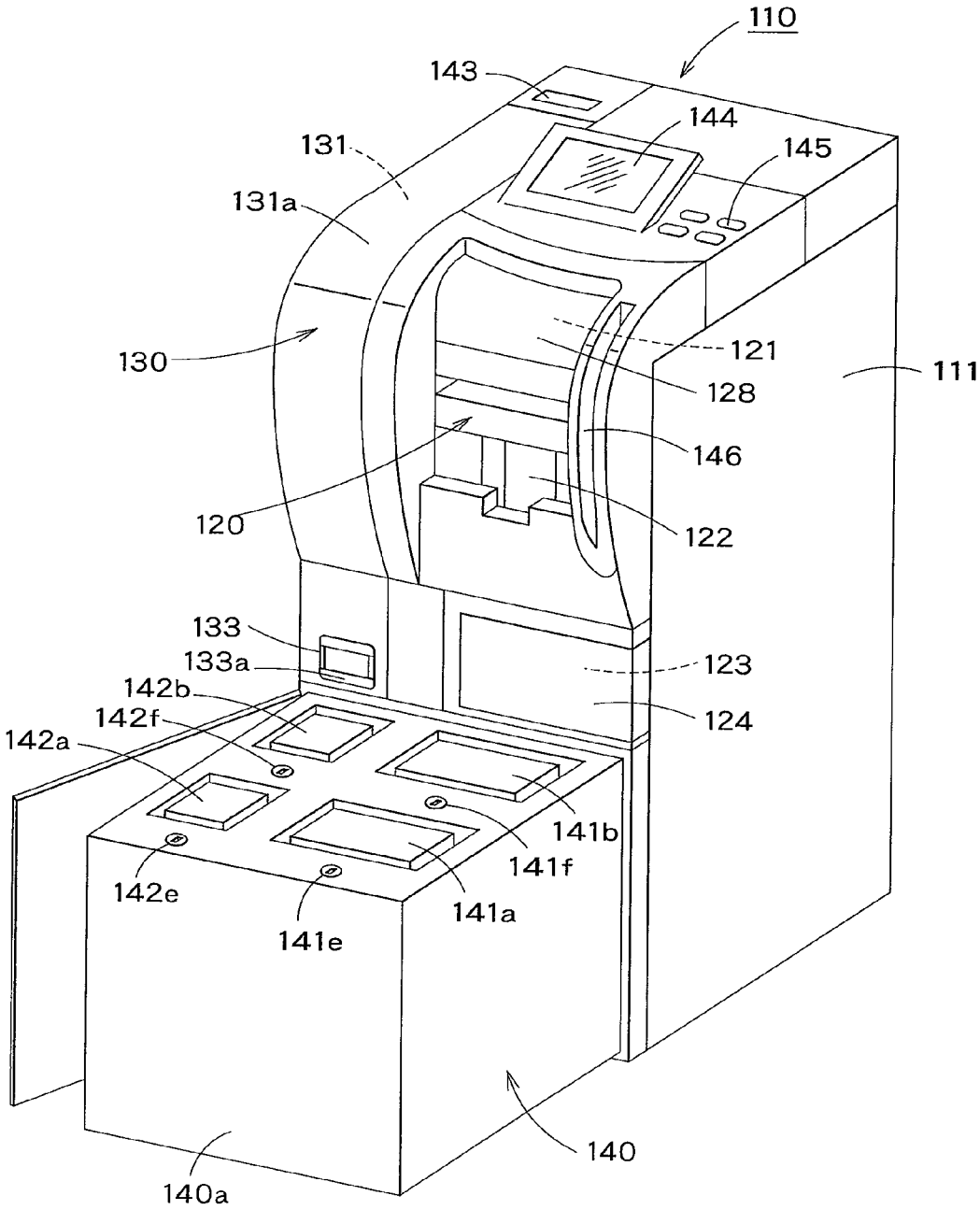
FIG. 13 is a perspective view illustrating the money handling machine shown in FIG. 9, with the money storing unit being pulled out forward from the casing.

Next, the money handling machine related to the third embodiment of the present invention will be described, with reference to the drawings. The money handling machine related to this embodiment includes the money storing unit adapted for storing therein the money, such as the banknotes, coins or the like, respectively taken in the casing from the exterior thereof. FIGS. 9 through 13 are provided for respectively illustrating the money handling machine related to the third embodiment of this invention. Of these drawings, the perspective view of FIG. 9 illustrates the construction of the money handling machine related to this embodiment, and FIG. 10 schematically illustrates the construction of the banknote handling machine provided in the money handling machine shown in FIG. 9. FIG. 11 schematically illustrates the construction of the coin handling machine provided in the money handling machine shown in FIG. 9, and the block diagram of FIG. 12 is provided for illustrating the control system of the money handling machine shown in FIG. 9. In addition, the perspective view of FIG. 13 is provided for illustrating the money handling machine shown in FIG. 9, with the money storing unit being pulled out forward from the casing.

As shown in FIG. 9, a money handling machine 110 includes a casing 111 having a substantially rectangular shape. In this casing 111, a banknote handling machine 120 located in an upper right portion of the money handling machine 110 when this machine 110 is seen from the front and a coin handling machine 130 located in an upper left portion of the money handling machine 110 when this machine 110 is seen from the front are laterally arranged. Further, in the casing 111 of the money handling machine 110, a money storing unit 140 adapted for storing therein the coins and banknotes is provided below the banknote handling machine 120 and coin handling machine 130. In this money handling machine 110, the banknote handling machine 120 and coin handling machine 130 are respectively managed under the management authority provided on the side of the store, while the money storing unit 140 is managed under the management authority provided on the side of the person in charge of collecting the money. Hereinafter, each component of the banknote handling machine 120, coin handling machine 130 and money storing unit 140 will be described in detail.

Now, referring to FIGS. 9 through 13, especially referring to FIG. 13, the construction of the money storing unit 140 will be described. First, as shown in FIG. 9 and other related drawings, the banknote storing unit 140 is provided in a lower portion of the casing 111 of the money handling machine 110.

The perspective view of FIG. 13 illustrates the money handling machine shown in FIG. 9, with the money storing unit 140 being pulled out forward from the casing 111. As shown in FIG. 13, the money storing unit 140 includes two banknote storing cassettes 141*a*, 141*b* and two coin storing cassettes 142*a*, 142*b*. Further, as shown in FIG. 10, the two banknote storing cassettes 141*a*, 141*b* are provided, respectively corresponding to the banknote handling machine 120. Meanwhile, as shown in FIG. 11, the two coin storing cassettes 142*a*, 142*b* are provided, respectively corresponding to the coin handling machine 130.

Each banknote storing cassette 141*a*, 141*b* can serve to receive the banknotes that have been transported to a escrow unit 129 (that will be described later) of the banknote handling machine 120 and then fed thereto from the escrow unit 129. Meanwhile, each coins storing cassette 142*a*, 142*b* can serve to receive the coins that have been transported to a escrow unit 137 (that will be described later) of the coin handling machine 130 and then fed thereto from the escrow unit 137.

In this case, the money storing unit 140 can be pulled out forward from the casing 111, and then each storing cassette 141*a*, 141*b*, 142*a*, 142*b* can be taken out from a main body 140*a* of the money storing unit 140, for example, by a certain person in charge of collecting the sales proceeds. In this way, the person in charge of collecting the sales proceeds can collect each storing cassette 141*a*, 141, 142*a*, 142*b* itself. Specifically, as shown in FIG. 10, regulation units 141*c*, 141*d* are respectively provided to the banknote storing cassettes 141*a*, 141*b*. More specifically, one regulation unit 141*c* is provided for regulating the operation for taking out the banknote storing cassette 141*a* from the main body 140*a*, and the other regulation unit 141*d* is provided for regulating the operation for taking out the banknote storing cassette 141*b* from the main body 140*a*. Further, as shown in FIG. 11, other regulation units 142*c*, 142*d* are respectively provided to the coin storing cassettes 142*a*, 142*b*. In this case, one regulation unit 142*c* is provided for regulating the operation for taking out the coin storing cassette 142*a* from the main body 140*a*, and the other regulation unit 142*d* is provided for regulating the operation for taking out the coin storing cassette 142*b* from the main body 140*a*.

Further, as shown in FIG. 13, key holes 141*e*, 141*f*, 142*e*, 142*f* are provided, respectively, in the vicinity of the storing cassettes 141*a*, 141*b*, 142*a*, 142*b*, in a top face of the main body 140*a* of the money storing unit 140. The key holes 141*e*, 141*f*, 142*e*, 142*f* are formed, differently from one another, such that each key can be inserted in each corresponding key hole, in a one-to-one relationship. In this case, when a certain key is inserted and rotated in one corresponding key hole 141*e*, 141*f*, 142*e* or 142*f*, the corresponding regulation unit 141*c*, 141*d*, 142*c* or 142*d* will be operated, such that the regulation of the operation for taking out the corresponding cassette 141*a*, 141*b*, 142*a* or 142*b* from the main body 140*a* can be released.

Otherwise, each regulation unit 141*c*, 141*d*, 142*c*, 142*d* may be composed of, for example, an automatic locking mechanism. In this case, the ID information of the operator is first confirmed by the ID card carried by the operator, and then an inquiry about whether or not the operator is authorized to take out each cassette 141*a*, 141*b*, 142*a*, 142*b* is made to the higher-ranking machine (that will be described later). As a result, once it is confirmed that the operator is authorized, the automatic locking mechanism will be released.

It is noted that each unit provided in the money storing unit 140 and adapted for storing therein the banknotes or coins is not limited to such a cassette-type unit as described above. For instance, a plurality of storing bags, each adapted for storing therein the banknotes or coins, may be provided in the money storing unit 140.

Next, referring to FIGS. 9 and 10, the construction of the banknote handling machine 120 will be described. As shown in FIGS. 9 and 10, the banknote handling machine 120 includes a banknote inlet 121 adapted for allowing the banknotes to be taken into the banknote handling machine 120, a banknote reject slot 122 adapted for rejecting the counterfeit banknotes or unrecognizable banknotes, among the banknotes taken in the banknote handling machine 120, and a banknote return slot 123 adapted for returning the banknotes that are not stored in the money storing unit 140, among the banknotes taken in the banknote handling machine 120, to the exterior of this banknote handling machine 120. Further, as shown in FIG. 10, a transport unit 125 adapted for transporting the banknotes, respectively taken in the banknote handling machine 120 via the banknote inlet 121, is provided in this banknote handling machine 120.

The banknote inlet 121 is configured for allowing one banknote or one batch of the plurality of banknotes to be collectively put or inserted in the long-edge first orientation. As shown in FIG. 9, a banknote inlet cover 128 that can be manually opened and closed is provided to the banknote inlet 121. In this case, only when the banknote inlet cover 128 is opened, the operator can insert the banknotes through the banknote inlet 121. Further, as shown in FIG. 10, the banknote inlet 121 is connected with the transport unit 125, such that one banknote or one batch of the plurality of banknotes inserted through the banknote inlet 121 can be fed out and transported, one by one, by the transport unit 125.

The banknote reject slot 122 is connected with the transport unit 125, as shown in FIG. 10, such that the banknotes respectively recognized as the banknotes to be rejected or banknotes that cannot be recognized, by a recognition unit 126 that will be described later, among the banknotes taken in the banknote handling machine 120 via the banknote inlet 121, can be fed to this reject slot 122 from the transport unit 125. In this case, the operator can take out the banknotes fed to the banknote reject slot 122. A cover (not shown) is provided to the banknote reject slot 122. This cover is opened during a waiting time of the machine, while being closed during the operation of the machine.

Further, as shown in FIG. 10, the escrow unit 129 connected with the transport unit 125 is provided to the banknote return slot 123. This escrow unit 129 can serve to receive and hold the banknotes respectively fed from the transport unit 125. In addition, a door 124 that can be optionally opened and closed is provided to the banknote return slot 123. In the case of returning the banknotes held in the escrow unit 129, a wall face of the escrow unit 129 located on the front face side of the machine is opened to allow the operator to take out the banknotes through the opened door 124. In this case, when the banknotes are respectively in the condition that can allow the banknotes to be taken out, the door 124 will be automatically opened. In some cases, as will be described later, the banknotes held in the escrow unit 129 will be fed to each banknote storing cassette 141*a*, 141*b* located in the money storing unit 140, in place of being taken out from the banknote return slot 123 by the operator.

The transport unit 125 can serve to transport the banknotes, one by one, successively, in the banknote handling machine 120. More specifically, in this transport unit 125, each banknote is transported, while being grasped or held between the pair of belts. Further, as shown in FIG. 10, the transport path provided in the transport unit 125 is bifurcated at various points, and the diverters (not shown) are provided, respectively, at the same points as the respective points at which the transport path is bifurcated. Each diverter is composed of, for example, one bifurcating nail, and is controlled by a control unit 115 that will be described later. Namely, as shown in FIG. 10, the banknote transport unit 125 can serve to transport the banknotes, respectively inserted through the banknote inlet 121, to the banknote reject slot 122 or escrow unit 129.

Further, as shown in FIG. 10, the recognition unit 126 is provided along the transport unit 125. This recognition unit 126 is adapted for recognizing each banknote transported by the transport unit 125, one by one. Specifically, the recognition unit 126 can serve to recognize each banknote transported by the transport unit 125, about the denomination, authentication, fitness and the like thereof. More specifically, this recognition unit 126 includes a magnetic sensor or optical sensor adapted for recognizing the banknotes, one by one, about the denomination, authenticity or the like thereof. The recognition result on each banknote recognized by the recognition unit 126 is sent to the control unit 115 that will be described later.

As described above, the escrow unit 129 is provided to the banknote return slot 123, and is connected with the transport unit 125 as shown in FIG. 10. This escrow unit 129 serves to receive the banknotes inserted through the banknote inlet 121 and then fed thereto by the transport unit 125. In this case, the escrow unit 129 is adapted for holding the plurality of banknotes in the batch form. Further, in this case, when the door 124 is opened by the operator, the banknotes stored in the escrow unit 129 can be taken out by the operator. A bottom plate that can be optionally opened and closed is provided to a bottom face of the escrow unit 129, such that the banknotes stored in the escrow unit 129 can be placed on this bottom plate. Further, in this case, as shown in FIG. 10, the escrow unit 129 can be moved reciprocally between a position fixed above the banknote storing cassette 141*a* (i.e., the position denoted by a solid line in FIG. 10) and another position fixed above the banknote storing cassette 141*b* (i.e., the position denoted by a two-dot chain line in FIG. 10). Namely, in the case the banknotes fed to the escrow unit 129 are stored in the banknote storing cassette 141*a*, the escrow unit 129 is moved to the position above the banknote storing cassette 141*a*. Meanwhile, in the case the banknotes fed to the escrow unit 129 are stored in the banknote storing cassette 141*b*, the escrow unit 129 is moved to the position above the banknote storing cassette 141*b*.

Hereinafter, the operation for storing the banknotes once escrowed in the escrow unit 129, into the banknote storing cassette 141*a* or banknote storing cassette 141*b* will be described. In this case, the operation for storing the banknotes once escrowed in the escrow unit 129 into the banknote storing cassette 141*a* is performed in the same manner as the operation for storing the banknotes once escrowed in the escrow unit 129 into the banknotes storing cassette 141*b*. Therefore, only the operation for storing the banknotes once escrowed in the escrow unit 129 into the banknote storing cassette 141*a* will be described herein. Namely, when the banknotes escrowed in the escrow unit 129 are stored in the banknote storing cassette 141*a*, a stage provided in the banknote storing cassette 141*a* is elevated, such that a top face of the banknotes placed on this stage can be positioned just below the bottom plate of the escrow unit 129. Then, the bottom plate is horizontally moved to be opened, and thus the banknotes escrowed in the escrow unit 129 will be dropped downward onto the banknotes placed on the stage. Thereafter, the banknotes placed on the stage are pressed from above by a holding member, and then the stage is lowered to store such banknotes in the banknote storing cassette 141*a*.

Next, referring to FIGS. 9 and 11, the construction of the coin handling machine 130 will be described. As shown in FIGS. 9 and 11, the coin handling machine 130 includes a coin inlet 131 provided for allowing the coins to be taken into the coin handling machine 130, and a coin return slot 133 provided for returning the reject coins, such as the unrecognizable coins for a recognition unit 135*a* that will be described later, among the coins taken in the coin handling machine 130, as well as returning the coins, not respectively stored in the money storing unit 140, among the coins taken in the coin handling machine 130, to the exterior of the coin handling machine 130. Further, a coin inlet cover 131*a* that can be optionally opened and closed is provided to the coin inlet 131. In addition, a coin return box 133*a* that can be optionally drawn out is provided to the coin return slot 133.

Additionally, an accumulation and feeding unit 134 is provided in the coin handling machine 130. This accumulation and feeding unit 134 can serve to receive and accumulate therein the coins respectively put into the coin handling machine 130 via the coin inlet 131 and then feed out such coins, one by one. Further, the accumulation and feeding unit 134 can serve to allow deformed coins, foreign material or the like to be dropped and discharged downward, when a bottom portion of this unit 134 is opened. Namely, an opening and closing mechanism (not shown) is provided to the bottom portion of the accumulation and feeding unit 134, such that the deformed coins, foreign material or the like accumulated in this unit 134 can be dropped and discharged downward, when the opening and closing mechanism is opened.

Further, the transport unit 135 is provided in the coin handling machine 130. This transport unit 135 can serve to transport the coins respectively fed out from the accumulation and feeding unit 134, one by one, and then divert the coins toward each destination of the transportation, based on the recognition result about the denomination, authenticity, fitness or the like of each coin recognized by the recognition unit 135*a* during the transportation. The transport unit 135 is connected with a coins return box 133*a*, such that the reject coins or the like can be returned to the coin return box 133*a* from the transport unit 135. In this case, the transport unit 135 first extends from its upstream-side end connected with the accumulation and feeding unit 134 toward the back side in the casing 111 (or rightward in FIG. 11), and is then folded up on the back side in the casing 111, and further extends toward the front side in the casing 111 (or leftward in FIG. 11). With this configuration, the coins transported by the transport unit 135 can be finally dropped downward into the coin return box 133*a*.

In the middle of the transport unit 135 on the downstream side in the transport direction relative to the recognition unit 135*a*, a diverter 135*b* adapted for diverting the coins, respectively recognized as the normal or regular coins by the recognition unit 135*a*, from the transport unit 135 is provided. This diverter 135*b* can optionally advance and retreat relative to the transport path of the transport unit 135, depending on the recognition result on each coin recognized by the recognition unit 135*a*, so as to selectively divert the coins to be transported to a escrow unit 137 that will be described later from the transport unit 135 as well as to allow the reject coins to be continuously transported by the transport unit 135. In a position where the diverter 135*b* is located, a top end of a chute 135*c* adapted for receiving and downwardly guiding the coins diverted by the diverter 135*b* is positioned. Meanwhile, a bottom end of this chute 135*c* is located in a position above fixed the escrow unit 137 when this unit 137 is located in a first storing position "a" (that will be described later).

As shown in FIG. 11, in the coin handling machine 130, the escrow unit 137 capable of escrowing or temporarily holding therein the coins fed out from the transport unit 135 is provided. This escrow unit 137 is formed into a frame-like shape opened upward and downward, and is located lower than the accumulation and feeding unit 134 in the casing 111. In this case, the escrow unit 137 can be moved reciprocally in both of the forward and backward directions in the casing 111 by a drive mechanism 137*b* (in other words, this escrow unit 137 can be moved reciprocally in the lateral direction in FIG. 11). It is noted that the escrow unit 137 can serve to store therein the coins in a greater amount than the capacity of the accumulation and feeding unit 134 for storing therein the coins.

In this embodiment, the escrow unit 137 is stopped in four positions, i.e., the first storing position "a" located above the coin storing cassette 142*a*, a removal position "b" located below the accumulation and feeding unit 134, a return position "c" located above the coin return box 133*a*, and a second storing position "d" located above the coin storing cassette 142*b* (see FIG. 11). Each stop position "a" to "d" of the escrow unit 137 is detected by a position detection unit 137*c*. Usually, the first storing position "a" is used as a fixed position for the escrow unit 137.

A bottom plate 137*a* for closing the bottom face of the escrow unit 137 is provided under the escrow unit 137. This bottom plate 137*a* extends in the substantially horizontal direction, and is capable of being moved reciprocally in both of the forward and backward directions in the casing 111 by a proper drive mechanism 137*f* (in other words, this bottom plate 137*a* can be moved reciprocally in the lateral direction in FIG. 11). In this case, the bottom plate 137*a* is stopped in two positions, i.e., a first position "m" just below the escrow unit 137 when it is located in the first storing position "a", and a second position "n" just below the escrow unit 137 when it is located in the second storing position "d" (see FIG. 11). Each of the two stop positions "m" and "n" of the bottom plate 137*a* is detected by a suitable position detection unit 137*g*. Usually, the first position "m" is used as a fixed position for the bottom plate 137*a*.

A coin storing chute 137*d* adapted for feeding the coins escrowed in the escrow unit 137 into the coin storing cassette 142*a* is provided in one position below the escrow unit 137 when it is located in the first storing position "a". Further, another coin storing chute 137*e* adapted for feeding the coins escrowed in the escrow unit 137 into the coin storing cassette 142*b* is provided in another position below the escrow unit 137 when it is located in the second storing position "d".

When the escrow unit 137 is located in its fixed position (i.e., the first storing position "a") and when the bottom plate 137*a* is located in its fixed position (i.e., the first position "m"), as shown in FIG. 11, the escrow unit 137 can receive the coins fed out from the transport unit 135 via the chute 135*c*, and escrow or temporarily hold therein such received coins. Meanwhile, when the escrow unit 137 is located in its fixed position (i.e., the first storing position "a") and when the bottom plate 137*a* is located in the second position "n", the coins fed out from the transport unit 135 via the chute 135*c* are directly fed to the coin storing chute 137*d*, after passing through the escrow unit 137 (i.e., without being escrowed or temporarily held in the escrow unit 137), and finally fed to the coin storing cassette 142*a*.

Namely, when the escrow unit 137 is located in its fixed position (i.e., the first storing position "a") and when the bottom plate 137*a* is located in the second position "n", a direct depositing operation (or depositing operation without escrowing the coins) for directly depositing the coins, respectively fed to the escrow unit 137 from the transport unit 135 via the chute 135*c*, into the coin storing cassette 142*a* can be performed.

Further, when the escrow unit 137 is located in the removal position "b" and when the bottom plate 137*a* is located in its fixed position (i.e., the first position "m"), this escrow unit 137 can receive the coins dropped and discharged downward from the accumulation and feeding unit 134. In this case, the escrow unit 137 is located to partly get out of the bottom plate 137*a*, and thus the bottom face of this escrow unit 137 can be partly opened. As such, a part of the coins received in the escrow unit 137 is dropped and discharged into the coin return box 133*a* located below the unit 137. After this dropping and discharging process, the escrow unit 137 can be further moved to the return position "c", so as to drop and discharge all of the coins remaining in the escrow unit 137 into the coin return box 133*a*. In this way, the coins can be returned to the exterior.

Namely, when the escrow unit 137 is moved from the first storing position "a" to the return position "c", the escrow unit 137 completely gets out of the bottom plate 137*a*, and thus the bottom face of this unit 137 is wholly opened. Therefore, in this state, the coins transported to the escrow unit 137 will be dropped downward into the coin return box 133*a*.

Further, when the escrow unit 137 is moved from the first storing position "a" to the second storing position "d" and when the bottom plate 137*a* is stayed in its fixed position (i.e., the first position "m"), the escrow unit 137 gets out of the bottom plate 137*a*, and thus the bottom face of this unit 137 is opened. Therefore, the coins transported to the escrow unit 137 will be dropped downward into the coin storing chute 137*e*, and finally fed into the coin storing cassette 142*b*.

Next, other various mechanisms respectively provided to the money handling machine 110 will be described. As shown in FIG. 9, an operation unit 145 for allowing the operator to input the various commands to the control unit 115 (that will be described later) of the money handling machine 110, and a display unit 144 for displaying the process contents concerning the money in the money handling machine 110 are respectively provided to a top face of the casing 111 of the money handling machine 110. In this case, the operation unit 145 includes numeric keys, accept key, start key, clear key and reset key, respectively provided, such that the operator can input the various commands to the control unit 115 of the money handling machine 110, by pushing such keys.

More specifically, the operator can input the amount of the money (or amount of transaction money), such as the banknotes, coins or the like, related to a transaction and put into the banknote inlet 121 of the banknote handling machine 120 or coin inlet 131 of the coin handling machine 130, via the operation unit 145. In this case, the amount of the transaction money inputted by the operator via the operation unit 145 corresponds to the amount of the money actually put, by the operator, into the banknote inlet 121 of the banknote handling machine 120 or coin inlet 131 of the coin handling machine 130. Further, the operator can input transaction information on the transaction related to the money, such as the banknotes, coins or the like, put into the banknote inlet 121 of the banknote handling machine 120 or coin inlet 131 of the coin handling machine 130, via the operation unit 145. Herein, the transaction information means, for example, the ID information or the like of the operator, date and time on which a certain operation is performed, information on a certain store, information on a certain register or the like. Namely, the operation unit 145 can serve as a transaction-money-amount input unit adapted for allowing the amount of the transaction money used for the transaction and related to the money put into the banknote inlet 121 of the banknote handling machine 120 or coin inlet 131 of the coin handling machine 130 to be inputted, or serve as a transaction-information input unit adapted for allowing the transaction information concerning the transaction to be inputted.

The display unit 144 is composed of, for example, the liquid crystal display (LCD). In the top face of the casing 111 of the money handling machine 110, a printer 143 adapted for printing the process contents or the like for the money in the money handling machine 110 is provided.

Further, in a front face of the casing 111, a card reader 146 used for confirming or checking the authority for operating the money handling machine 110 or the like of the operator is provided. In this case, the card reader 146 serves to read the ID information of the ID card carried by each operator. In addition, a memory unit 147 adapted for storing therein various information is provided in the casing 111.

Now, referring to FIG. 12, the control unit 115 adapted for controlling each component provided in the money handling machine 110 will be described. This control unit 115 is located in the casing 111 of the money handling machine 110.

As shown in FIG. 12, the control unit 115 is connected with each component of the banknote handling machine 120 (e.g., the transport unit 125, recognition unit 126, door 124, escrow unit 129 and the like), and is also connected with each component of the coin handling machine 130 (e.g., the accumulation and feeding unit 134, transport unit 135, recognition unit 135*a*, drive mechanism 137*b* for the escrow unit 137, position detection unit 137*c* for the escrow unit 137, drive mechanism 137*f* for the bottom plate 137*a*, position detection unit 137*g* for the bottom plate 137*a*, and the like). Further, the control unit 115 is connected with the display unit 144, operation unit 145, printer 143, card reader 146, memory unit 147 and the like.

This control unit 115 can serve to receive the recognition result on each banknote sent from the recognition unit 126 of the banknote handling machine 120 as well as receive the recognition result on each coin sent from the recognition unit 135*a* of the coin handling machine 130. Further, the control unit 115 can serve to receive information, such as the position information on the escrow unit 137 detected by the position detection unit 137*c*, position information on the bottom plate 137*a* detected by the position detection unit 137*g*, and the like. In addition, the control unit 115 can serve to receive the ID information of the ID card of the operator read by the card reader 146. Further, the control unit 115 can serve to control each component of the banknote handling machine 120 or coin handling machine 130, as well as control the display unit 144, operation unit 145, printer 143 and the like. Additionally, the control unit 115 can transmit and receive the signal relative to the higher-ranking machine via the interface 116 connected with the control unit 115, this higher-ranking machine being installed, by, for example, the money collector. Further, in this case, the control unit 115 is connected with the memory unit 147, such that each recognition result and information as described above can be stored in this memory unit 147.

Next, the object that can be achieved by this embodiment of the present invention will be discussed.

First, as one comparative example, one prior-art money handling machine will be described. For instance, in the store, such as a shopping center or the like, where a plurality of registers are provided, one or more money handling machines, as disclosed in JP2001-67526A, are installed. Usually, in such a store after it is closed, surplus money remaining in each register and related to the sales proceeds is deposited into each corresponding money handling machine. In this case, the money storing unit adapted for storing therein the money, such as the banknotes, coins or the like, is provided in each money handling machine, and the management authority for managing this money storing unit is provided on the side of the person in charge of collecting the money of the money collector. Therefore, once the money is stored in each money storing unit, this money will be delivered to the person in charge of collecting the money. In this delivery process, the person in charge of collecting the money will suitably collect such delivered money in the money storing unit. Further, with this delivery process for the money, the amount of the money delivered to the person in charge of collecting the money will be deposited into a predetermined bank account on the side of the store.

Meanwhile, for each register in the store, it is necessary to prepare the change to be used on the next business day. In this case, the banknotes or coins corresponding to the change will be delivered to the store, depending on an order given to the money collector. Then, the delivered change is loaded in a money changer or the like, and exchanged for the money stored in each register, so as to prepare the change used therein.

Namely, as described above, all of the surplus money related to the sales proceeds and remaining in each register after the store is closed is collected by the person in charge of collecting the money, while the money prepared for the change is delivered from the person in charge of collecting the money. Therefore, in some cases, the amount of money of the change required becomes considerably large. Of course, in such a case, the fee necessary for delivering the money for preparing the change is increased so much. Additionally, in order to prevent the money storing unit of each money handling machine from being full up with the money, it is sometimes necessary to have the money collecting work for collecting the sales proceeds performed so frequently by the person in charge of collecting the money.

However, if the money stored in the money storing unit can be partly used as the change, the quantity of the money delivered as the change to be prepared in the store can be substantially decreased. Thus, for the store, the fee necessary for delivering the money for preparing the change can be decreased so much. Meanwhile, for the money collector, since the money stored in the money storing unit is partly used as the change, the time required for the money storing unit to be full up with the money can be extended. As such, the frequency in the collecting work for collecting the money can be substantially lowered.

Therefore, in order to enable the money stored in the money storing unit to be partly used as the change, the money storing unit 140 provided in the money handling machine 110 of the above embodiment as shown in FIG. 9 is intended for storing therein the money deposited into the money handling machine, such that the money that will be used as the change in the store and managed on the side of the store can be stored in this money storing unit 140, separately from the money to be managed on the side of the person in charge of collecting the money.

Namely, among the two banknote storing cassettes 141*a*, 141*b* of the money storing unit 140 in the money handling machine 110 shown in FIG. 9, one banknote storing cassette 141*a* is managed under the management authority provided on the side of the person in charge of collecting the money, and the other banknote storing cassette 141*b* is managed under the management authority provided on the side of the store. Similarly, among the two coin storing cassettes 142*a*, 142*b* of the money storing unit 140, one coin storing cassette 142*a* is managed under the management authority provided on the side of the person in charge of collecting the money, and the other coin storing cassette 142*b* is managed under the management authority provided on the side of the store.

More specifically, as shown in FIG. 13, both of the operator on the side of the store and the person in charge of collecting the money can pull out the main body 140*a* of the money storing unit 140, forward, from the casing 111. In this case, the person in charge of collecting the money has the keys respectively corresponding to the key holes 141*e*, 142*e* respectively located in the vicinity of the banknotes storing cassette 141*a* and coin storing cassette 142*a*. Meanwhile, the operator on the side of the store has the keys respectively corresponding to the key holes 141*f*, 142*f* respectively located in the vicinity of the banknotes storing cassette 141*b* and coin storing cassette 142*b*. As such, the person in charge of collecting the money can take out the banknote storing cassette 141*a* and coin storing cassette 142*a* from the casing 111, while the operator on the side of the store can take out the banknote storing cassette 141*b* and coin storing cassette 142*b* from the casing 111. Each storing cassette 141*a*, 142*a* is locked, at an inlet or the like thereof, at least when it is pulled out from the casing 111, such that the money stored therein cannot be taken out therefrom.

Now, in regard to the money handling machine 110 in which the management authority for managing the money storing unit 140 is separated into such two sides as described above, the operation for storing the money deposited into the money handling machine 110 in the money storing unit 140 will be described. Namely, this operation is performed for storing the money in the money storing unit 140, such that the money that will be used as the change in the store and managed on the side of the store can be stored in this money storing unit 140, separately from the money to be managed on the side of the person in charge of collecting the money.

First of all, a first delivery process (or depositing process) for the banknotes for storing the banknotes, respectively put into the banknote handling machine 120, as the banknotes to be managed on the side of the person in charge of collecting the money, in the money storing unit 140 will be described. Namely, in this first delivery process for the banknotes, when the operator puts the banknotes into the banknote handling machine 120 via the banknote inlet 121, the banknotes respectively inserted through the banknote inlet 121 are transported, one by one, by the transport unit 125, and then recognized by the recognition unit 126. As a result, the banknotes, respectively recognized, as the normal banknotes, by the recognition unit 126, are fed to the escrow unit 129 by the transport unit 125. Meanwhile, the banknotes, respectively recognized, as the reject banknotes, such as the counterfeit banknotes or the like, by the recognition unit 126, are fed to the banknote reject slot 122 by the transport unit 125.

After this process for the banknotes is performed, if the operator pushes the "ACCEPT" key in the operation unit 145 and inputs a command for performing a delivery accept process to the control unit 115, the banknotes escrowed in the escrow unit 129 will be fed into the banknote storing cassette 141*a* of the banknote storing unit 140.

Next, a second delivery process (or depositing process) for the banknotes for storing the banknotes, respectively put into the banknote handling machine 120, as the banknotes used as the change in the store and managed on the side of the store, in the money storing unit 140 will be described. In this second delivery process for the banknotes, when the operator puts the banknotes into the banknote handling machine 120 via the banknote inlet 121, the banknotes respectively inserted through the banknote inlet 121 are transported, one by one, by the transport unit 125, and then recognized by the recognition unit 126. As a result, the banknotes, respectively recognized, as the normal banknotes, by the recognition unit 126, are fed to the escrow unit 129 by the transport unit 125. Meanwhile, the banknotes, respectively recognized, as the reject banknotes, such as the counterfeit banknotes or the like, by the recognition unit 126, are fed to the banknote reject slot 122 by the transport unit 125.

After this process for the banknotes is performed, if the operator pushes the "ACCEPT" key in the operation unit 145 and inputs the command for performing the delivery accept process to the control unit 115, the escrow unit 129 will be moved to the position located above the banknote storing cassette 141*b*, and then the banknotes escrowed in this escrow unit 129 will be fed into the banknote storing cassette 141*b* of the banknote storing unit 140.

Next, a first delivery process (or depositing process) for the coins for storing the coins, respectively put into the coin handling machine 130, as the coins managed on the side of the person in charge of collecting the money, in the money storing unit 140 will be described. Namely, in this first delivery process for the coins, when the operator puts the coins into the coin handling machine 130 via the coin inlet 131, the coins respectively inserted through the coin inlet 131 are first fed to the accumulation and feeding unit 134, and then fed, one by one, to the transport unit 135 from the accumulation and feeding unit 134. At this time, the escrow unit 137 is located in the first storing position "a", and the bottom plate 137*a* is located in the first position "m". Then, the coins fed to the transport unit 135 are respectively recognized by the recognition unit 135*a*. As a result, the coins, respectively recognized, as the normal coins, by the recognition unit 135*a*, are diverted from the transport path of the transport unit 135 by the diverter 135*b* and fed to the escrow unit 137 via the chute 135*c*. Meanwhile, the coins, respectively recognized, as the reject coins, such as the unrecognizable coins for the recognition unit 135*a*, are directly fed to the coin return slot 133, without being diverted from the transport path of the transport unit 135.

After this process for the coins is performed, if the operator pushes the "ACCEPT" key in the operation unit 145 and inputs the command for performing the delivery accept process to the control unit 115, the bottom plate 137*a* will be moved from the first position "m" to the second position "n", by the drive mechanism 137*f*, and thus the bottom portion of the escrow unit 137 will be opened. Therefore, the coins transported to this escrow unit 137 will be dropped into the coin storing cassette 142*a* of the banknote storing unit 140. In this way, the coins can be stored in the coin storing cassette 142*a*.

Next, a second delivery process (or depositing process) for the coins for storing the coins, respectively put into the coin handling machine 130, as the coins used as the change and managed on the side of the store, in the money storing unit 140 will be described. Namely, in this second delivery process for the coins, when the operator puts the coins into the coin handling machine 130 via the coin inlet 131, the coins respectively inserted through the coin inlet 131 are first fed to the accumulation and feeding unit 134, and then fed, one by one, to the transport unit 135 from the accumulation and feeding unit 134. At this time, the escrow unit 137 is located in the first storing position "a", and the bottom plate 137*a* is located in the first position "m". Then, the coins fed to the transport unit 135 are respectively recognized by the recognition unit 135*a*. As a result, the coins, respectively recognized, as the normal coins, by the recognition unit 135*a*, are diverted from the transport path of the transport unit 135 by the diverter 135*b* and fed to the escrow unit 137 via the chute 135*c*. Meanwhile, the coins, respectively recognized, as the reject coins, such as the unrecognizable coins for the recognition unit 135*a* are directly fed to the coin return slot 133, without being diverted from the transport path of the transport unit 135.

After this process for the coins is performed, if the operator pushes the "ACCEPT" key in the operation unit 145 and inputs the command for performing the delivery accept process to the control unit 115, the escrow unit 137 will be moved from the first storing position "a" to the second storing position "d" by the drive mechanism 137*b*, and thus the bottom portion of this escrow unit 137 will be opened. Therefore, the coins transported to the escrow unit 137 will be dropped into the coin storing cassette 142*b* of the money storing unit 140. In this way, the coins can be stored in the coin storing cassette 142*b*.

In this case, the number for each denomination of the banknotes or coins on the side of the store to be stored in the banknote storing cassette 141*b* or coin storing unit 142*b* of the money storing unit 140 and used as the change in the store is set in advance in the control unit 115, and is stored in the memory unit 147.

Namely, in the money handling machine 10 in which the management authority for managing the money storing unit 140 is separated into the two sides as described above, the banknote storing cassette 141*a* and coin storing cassette 142*a* in the money storing unit 140 are respectively managed under the first management authority (i.e., the management authority provided on the person in charge of collecting the money), while the banknote storing cassette 141*b* and coin storing cassette 142*b* in the money storing unit 140 are respectively managed under the second management authority (i.e., the management authority provided on the side of the store). In this case, the control unit 115 serves to count the number for each denomination of the banknotes or coins transported to the escrow unit 129 or 137, based on the recognition result sent from each recognition unit 126, 135*a*. As a result, in regard to the banknotes or coins of a certain denomination recognized by the recognition unit 126 or 135*a*, if the total number of the banknotes or coins obtained by adding the number of the banknotes or coins escrowed or temporarily held in the escrow unit 129 or 137 to the number of the banknotes or coins stored in the banknote storing cassette 141*b* or coin storing cassette 142*b* is insufficient for the number set and stored in the memory unit 147, the control unit 115 serves to transport the banknotes or coins of the certain denomination to the escrow unit 129 or 137. However, in regard to the banknotes or coins of a certain denomination recognized by the recognition unit 126 or 135*a*, if the total number of the banknotes or coins obtained by adding the number of the banknotes or coins escrowed or temporarily held in the escrow unit 129 or 137 to the number of the banknotes or coins stored in the banknote storing cassette 141*b* or coin storing cassette 142*b* is equal to or greater than the number set and stored in the memory unit 147, the control unit 115 serves to transport such money to the banknote reject slot 122 or coin return slot 133.

Once the transportation for all of the banknotes or coins put into the money handling machine is ended, or when the total number of the banknotes or coins obtained by adding the number for each denomination of the banknote or coins transported to the escrow unit 129 or 137 to the number of the banknotes or coins stored in the banknote storing cassette 141*b* or coin storing cassette 142*b* is coincident with the number for each denomination of the banknotes or coins stored in the storing unit 147, the control unit 115 serves to transport the money escrowed or temporarily held in the escrow unit 129 or 137 to the money storing unit 140, so as to store such transported money in the banknote storing cassette 141*b* or coin storing cassette 142*b*. In this way, the banknotes or coins can be stored in the banknote storing cassette 141*b* or coin storing cassette 142*b*, until the number of such money reaches the number for each denomination set in advance. Therefore, such banknotes or coins stored in the banknote storing cassette 141*b* or coin storing cassette 142*b* can be used, as the change in the store, by the operator on the side of the store.

If the operator wants to deliver the banknotes or coins put into the banknote handling machine 120 or coin handling machine 130 to the person in charge of collecting the money, the operator inputs a command for performing the first delivery process for the banknotes or coins in the banknote handling machine 120 or coin handling machine 130, via the operation unit 145. As a result, the banknotes or coins put into the banknote handling machine 120 or coin handling machine 130 will be stored in the banknote storing cassette 141*a* or coin storing cassette 142*a* of the money storing unit 140. As described above, since the banknote storing cassette 141*a* or coin storing cassette 142*a* of the money storing unit 140 is managed under the management authority provided on the side of the person in charge of collecting the money, the banknotes or coins stored in such a cassette 141*a* or 142*a* will be delivered to the person in charge of collecting the money.

It should be noted that the operation of the money handling machine 110 in which the management authority for managing the money storing unit 140 is separated into the two sides is not limited to the aforementioned example. For instance, in one alternative operation, the operator may optionally select either one of the first delivery process (or depositing process) and second delivery process (or depositing process), via the operation unit 145 for each time.

The invention claimed is:

1. A money handling machine configured to handle money, the machine comprising:

a casing;

an insertion unit configured to allow the money to be put into the casing from the exterior thereof;

a dispensing unit configured to dispense the money present in the casing to the exterior of the casing;

a transport unit provided in the casing, connected with each of the insertion unit and dispensing unit, and configured to transport the money in the casing;

a recognition unit provided to the transport unit and configured to recognize the money put into the casing from the exterior thereof via the insertion unit;

a storing unit connected with the transport unit in the casing, and configured to store therein the money fed from the transport unit and feed the money stored therein to the transport unit;

an escrow unit connected with the transport unit in the casing, and configured to escrow the money put into the casing from the exterior thereof via the insertion unit and then recognized by the recognition unit; and a control unit configured to control the insertion unit, the transport unit, the storing unit and the escrow unit, wherein a predetermined amount of fund money that is the money to be dispensed is set in the control unit, and when a mode with a depositing and dispensing process is selected, the control unit serves to automatically perform a dispensing process for feeding the money corresponding to the predetermined amount of the fund money from the storing unit to the dispensing unit, after the control unit serves to perform a depositing process for taking the money into the casing from the exterior thereof via the insertion unit, and then feeding the money taken in the casing to the escrow unit.

2. The money handling machine according to claim 1, wherein the control unit serves to automatically perform a storing process for feeding the money from the escrow unit to the storing unit, after the control unit serves to perform the dispensing process.

3. The money handling machine according to claim 2, wherein the escrow unit is managed under first management authority, and the storing unit is managed under second management authority different from the first management authority, and when the money is fed from the escrow unit to the storing unit, the management authority for handling the money is shifted from the first management authority to the second management authority.

4. A money handling machine configured to handle money, the machine comprising:

a casing;

an insertion unit configured to allow the money to be put into the casing from the exterior thereof;

a dispensing unit configured to dispense the money present in the casing to the exterior of the casing;

a transport unit provided in the casing, connected with each of the insertion unit and dispensing unit, and configured to transport the money in the casing;

a recognition unit provided to the transport unit and configured to recognize the money put into the casing from the exterior thereof via the insertion unit;

a storing unit connected with the transport unit in the casing, and configured to store therein the money fed from the transport unit and feed the money stored therein to the transport unit; and a control unit configured to control the insertion unit, the transport unit and the storing unit, wherein a predetermined amount of fund money that is the money to be dispensed is set in the control unit, and when a mode with a depositing and dispensing process is selected, the control unit serves to automatically perform a dispensing process for feeding the money corresponding to the predetermined amount of the fund money from the storing unit to the dispensing unit, after the control unit serves to perform a storing process for taking the money into the casing from the exterior thereof via the insertion unit, and then feeding the money taken in the casing to the storing unit.

* * * * *